US010227866B2

(12) United States Patent
Godager et al.

(10) Patent No.: US 10,227,866 B2
(45) Date of Patent: Mar. 12, 2019

(54) METHOD AND SYSTEM FOR ALIGNMENT OF A WELLBORE COMPLETION

(71) Applicant: HALLIBURTON AS, Tananger (NO)

(72) Inventors: Øivind Godager, Sandefjord (NO); Fan-nian Kong, Oslo (NO); Bruce H. Storm, Jr., Houston, TX (US)

(73) Assignee: HALLIBURTON AS, Tananger (NO)

( * ) Notice: Subject to any disclaimer, the term of this patent is extended or adjusted under 35 U.S.C. 154(b) by 343 days.

(21) Appl. No.: 14/386,435

(22) PCT Filed: Mar. 15, 2013

(86) PCT No.: PCT/US2013/032571
§ 371 (c)(1),
(2) Date: Sep. 19, 2014

(87) PCT Pub. No.: WO2013/142381
PCT Pub. Date: Sep. 26, 2013

(65) Prior Publication Data

US 2015/0047839 A1 Feb. 19, 2015

Related U.S. Application Data

(60) Provisional application No. 61/613,268, filed on Mar. 20, 2012.

(30) Foreign Application Priority Data

Mar. 20, 2012 (NO) ..... 20120331

(51) Int. Cl.
*E21B 47/09* (2012.01)
*E21B 19/00* (2006.01)
*E21B 43/10* (2006.01)

(52) U.S. Cl.
CPC ..... *E21B 47/0905* (2013.01); *E21B 19/00* (2013.01); *E21B 43/10* (2013.01)

(58) Field of Classification Search
CPC ..... E21B 19/00; E21B 43/10; E21B 43/11; E21B 47/09; E21B 47/0905
See application file for complete search history.

(56) References Cited

U.S. PATENT DOCUMENTS 2,573,799 A * 11/1951 MacLean ..... G01B 7/10 324/119
2,897,438 A * 7/1959 Fearon ..... E21B 47/0905 324/221

(Continued)

OTHER PUBLICATIONS

PCT International Search Report and Written Opinion for PCT/US2013/032571, dated Jun. 14, 2014.

(Continued)

*Primary Examiner* — Robert E Fuller
*Assistant Examiner* — Christopher J Sebesta
(74) *Attorney, Agent, or Firm* — Haynes and Boone LLP

(57) ABSTRACT

Wireless downhole sensor technology is being deployed in oil and gas wells. System components are inductively coupled, which enables remote placement of apparatus on the outside of wellbore conduit without the need for any wired connection. These systems make use of a pair of conductive elements that need to be aligned in the well. Embodiments of the present invention provide techniques to correctly space out the wellbore completion string so that the down-hole conductive elements will be properly aligned and within proximity to establish wireless connectivity, as the wellbore completion string is set and the tubing hanger is landed inside the wellhead housing of the well.

18 Claims, 18 Drawing Sheets

(56) References Cited

U.S. PATENT DOCUMENTS

| | | | | |
|---|---|---|---|---|
| 3,845,381 | A * | 10/1974 | Hart | G01V 3/26 324/221 |
| 3,940,689 | A * | 2/1976 | Johnson, Jr. | E21B 47/082 324/221 |
| 6,142,236 | A * | 11/2000 | Brammer | E21B 7/12 166/351 |
| 6,411,084 | B1 * | 6/2002 | Yoo | G01N 27/82 166/255.1 |
| 7,455,105 | B1 * | 11/2008 | McKee | E21B 17/20 166/77.2 |
| 2002/0096331 | A1 | 7/2002 | Leismer et al. | |
| 2003/0141075 | A1 | 7/2003 | Bixenman et al. | |
| 2003/0183397 | A1 | 10/2003 | Hoffman | |
| 2009/0066535 | A1 | 3/2009 | Patel et al. | |
| 2010/0163224 | A1 * | 7/2010 | Strickland | E21B 33/12 166/254.1 |
| 2010/0309750 | A1 * | 12/2010 | Brady | E21B 47/0905 367/82 |
| 2011/0290011 | A1 * | 12/2011 | Dowla | E21B 17/08 73/152.16 |
| 2012/0024050 | A1 | 2/2012 | Godager | |
| 2013/0056197 | A1 * | 3/2013 | Maida | E21B 47/123 166/250.01 |

OTHER PUBLICATIONS

European Search Report issued for European Application No. 13873024.1 dated Feb. 3, 2016, 2016, 4 pages.

* cited by examiner

METHOD AND SYSTEM FOR ALIGNMENT OF A WELLBORE COMPLETION

BACKGROUND OF THE INVENTION

Field of the Invention

The invention relates to a method and system for alignment of a wellbore completion inside a casing of a well. More specifically the invention relates to a system and method for a one-way continuous inward movement of the well completion without the need of any reversing action or the need for mechanical locating elements in the casing and locating mating elements on the completion string.

Description of the Related Art

In the placement of tools and equipment (e.g., perforating tools, packers, valves, sensors, inductive coils, etc.) in a wellbore, the accuracy of depth referenced from the surface is known to entail a certain degree of uncertainty. While the length of casing joints installed in the well are generally known at the surface, the influences of the wellbore environment (e.g., compression, tension, and temperature) affect the length of the casing joints in the wellbore. Due to this uncertainty, it is of advantage to provide position references in the wellbore which may be used to determine the (relative) position of an element being run into the well. Currently, the placement of equipment in proximity to elements in a wellbore may be accomplished by use of mechanical locating members in the wellbore casing which engage locating mating members on the tool (or string) being run into the well.

Each of these methods generally requires a "dummy run," wherein the tool (e.g., string) is run into the well until the element in the wellbore is detected. The string is then retracted and the length adjusted such that the desired length is reinserted into the wellbore, for example, to land the tubing hanger with the down-hole elements in close proximity. This approach has a significant disadvantage when the well is a subsea well wherein the wellhead is located on the seafloor. In such cases, the completion may be run in on a workstring to determine the location of the downhole element. Then the workstring may be removed, the completion length adjusted, and the completion and workstring run in again and, finally, the workstring may be retrieved yet again, requiring substantial time and associated costs, and increasing the opportunity for injury to personnel and property. For wellheads located on the sea floor, and for deep sea waters, the wellhead may be up to three kilometers below the vessel or platform. In such installations there is a common problem that the exact length of the necessary tubing is not well known, and alignment of tubing and casing in the bottom of the well becomes difficult.

Another approach is to run a wireline tool to determine the depth of the wellbore element prior to running the completion. This requires the presence of additional equipment and personnel on the rig, and requires time and associated costs to rig up, run in, pull out, and rig down.

Yet another approach is to utilize a locating element on the casing with a mating element on the completion string such that the locating element and the mating element engage when the completion string reaches the desired depth.

SUMMARY OF THE INVENTION

One embodiment of the present invention provides a method for deploying a wellbore completion string in a wellbore. The method generally includes determining a position of a first element in the wellbore, determining a remaining length for deploying the wellbore completion string in the wellbore, wherein the remaining length is based on a distance between the first element and a second element in the wellbore, and adjusting a length of the wellbore completion string based on the remaining length for deploying the wellbore completion string in the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

With reference to the attached drawings the device and system according to the invention will now be explained in more detail.

Wireless downhole sensor technology is being deployed in numerous oil and gas wells. In the state of the art, system components are inductively coupled, which enables remote placement of autonomous apparatus on the outside of wellbore conduit without the need for any cable connection, cord, or battery to neither power nor communicate. These systems make use of a pair of inductive elements that need to be aligned in the well. A first inductive element is casing conveyed and typically placed on the outside of the wellbore casing or liner. A second inductive element is typically tubing conveyed and attached to the wellbore completion string. The wellbore completion string is run into the well and targeted to land in a location where the two inductive elements are aligned in the well. This is particularly challenging in deep wells or wells operated from a floating vessel or rig. Thus, one objective of this invention is to provide applicable methods and apparatus that assist to correctly space out the wellbore completion string in a practical manner so that the downhole inductive elements will be properly aligned and within proximity to establish wireless connectivity, as the wellbore completion string is set and the tubing hanger is landed inside the wellhead housing of the well.

Space out can be understood as the process required to add the necessary tubing to the top of the wellbore completion string as the wellbore completion string is lowered into the wellbore casing. At the end of the wellbore completion program, the wellbore completion string is landed and terminated in a tubing hanger in a wellhead housing. If the wellbore completion string is too long, the tubing has to be lifted up to remove some of the tubing. If the wellbore completion string is too short, more tubing has to be added.

Figure 1:
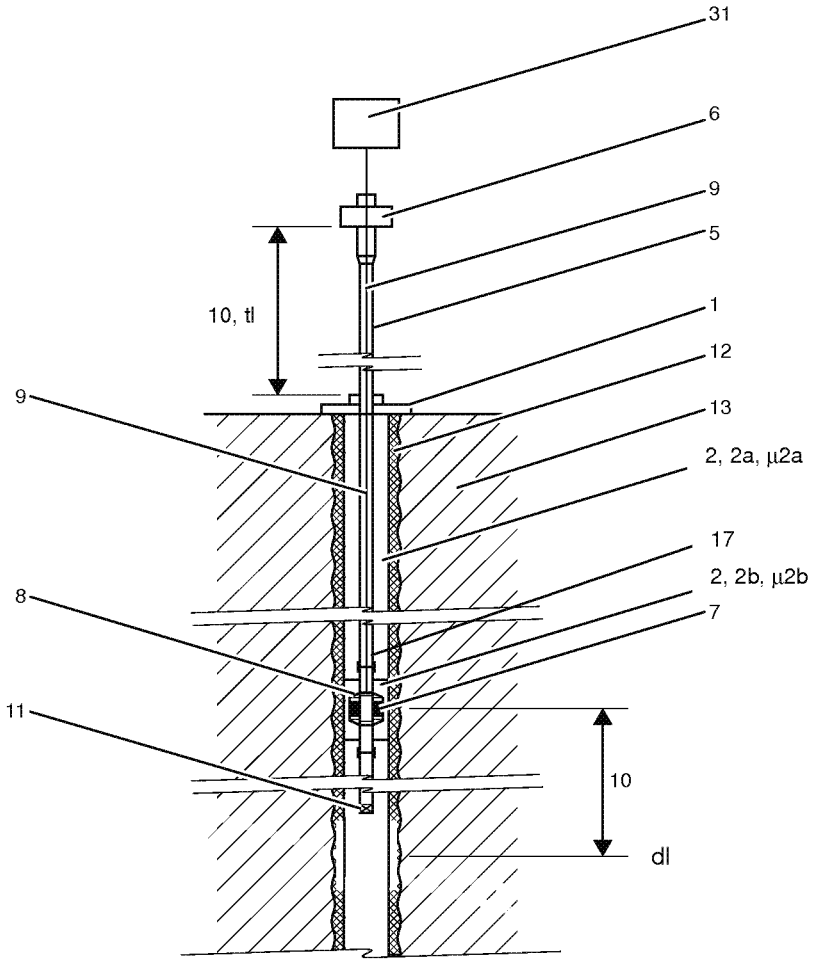
FIG. 1 is a section view of a well during well completion alignment.

FIG. 1 illustrates an embodiment of the invention showing a typical well with wellbore casing (2) and wellbore completion (5) program typically run by two independent operations and the wellbore completion (5). The well with the wellbore casing (2) is terminated by wellhead housing (1). The wellbore casing (2) projects through a formation (13) and is typically cemented (12) along its outer surface up to the wellhead housing (1). The wellbore casing segment is made up of first casing segments (2*a*) that are typically pipes or tubes of different length that are interconnected by casing joints (17). For the purpose of this invention the standard casing joints (17) are considered part of the casing segments, i.e.; a casing segment (2*a*) may consist of one or more tubes, and joints. However, as will be understood from the reminder of the document, it is the magnetic properties of these first casing segments (2*a*) that are important for this invention, and not other physical characteristics.

At a particular location in the well the wellbore casing (2) is provided with second casing segment (2*b*) in between two of the first casing segments (2*a*). The second casing segment (2*b*) is located and placed at a remaining distance (10) from a landing depth (dl). The magnitude of remaining distance (10) depends on the type of well and how the well is accessed. Typically the remaining distance (10) will be larger for a well operated from a vessel than a fixed land or platform well respectively.

Furthermore, and for the purpose of this invention, it is essential that the second magnetic permeability ($\mu$2*a*) of the second casing segment (2*b*) is different from a first magnetic permeability ($\mu$2*b*) of the remainder of the wellbore casing (2), i.e. the first casing segments (2*a*).

During the wellbore completion program, the wellbore completion (5) is inserted inside the wellbore casing (2) as can be seen from FIG. 1. Tubes and joints are continuously added to make the wellbore completion (5) longer as it penetrates deeper and deeper into the wellbore casing (2).

FIG. 1 further illustrates the wellhead housing (1) and the tubing hanger (6) above sea level, and the bottom hole assembly (11) as the bottom most component of the wellbore completion (5).

The wellbore completion (5) also comprises a first completion magnetic dipole or inductive element such as may be formed from a coil of conductive wire (8). This magnetic dipole (8) communicates with a surface device (31). Such communication is usually set up over a cable (9). It is known in the art that an electrical current flowing through a coil of conductive wire produces a magnetic dipole.

Figure 5:
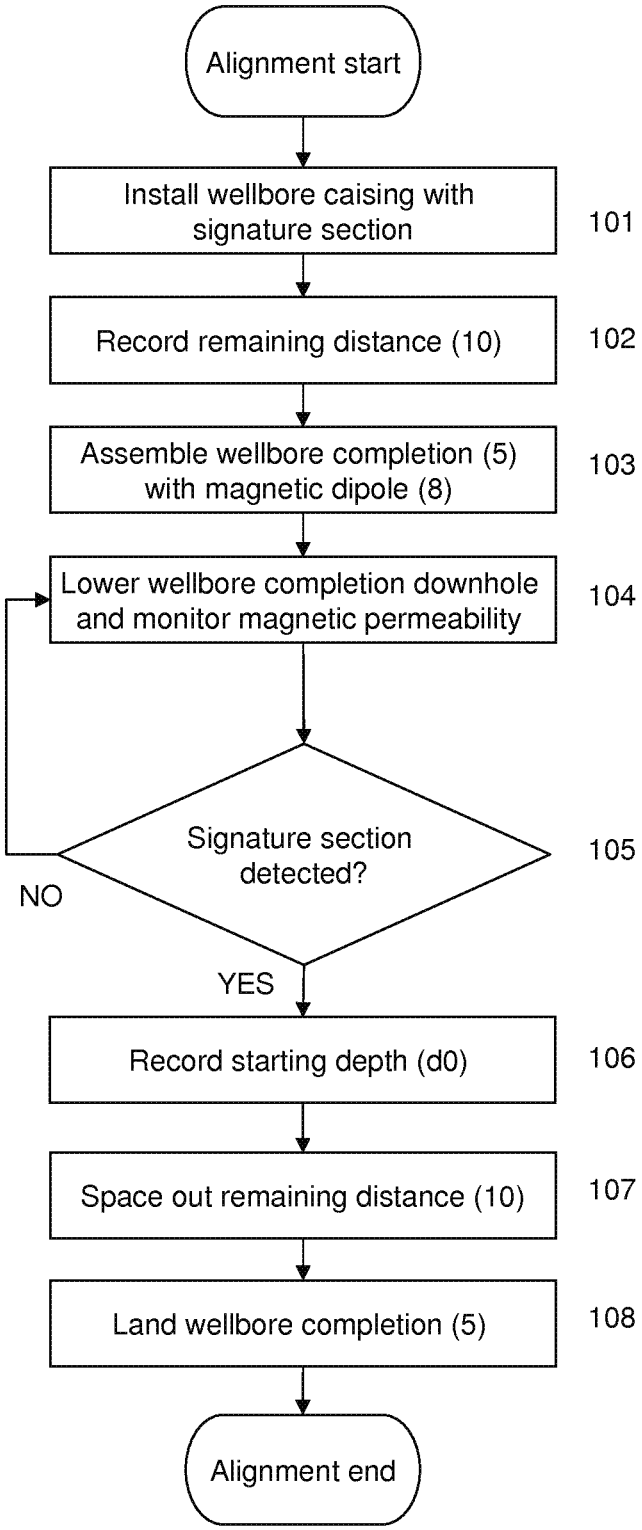
FIG. 5 shows a in a flow diagram a wellbore completion alignment method for a well.
Figure 6:
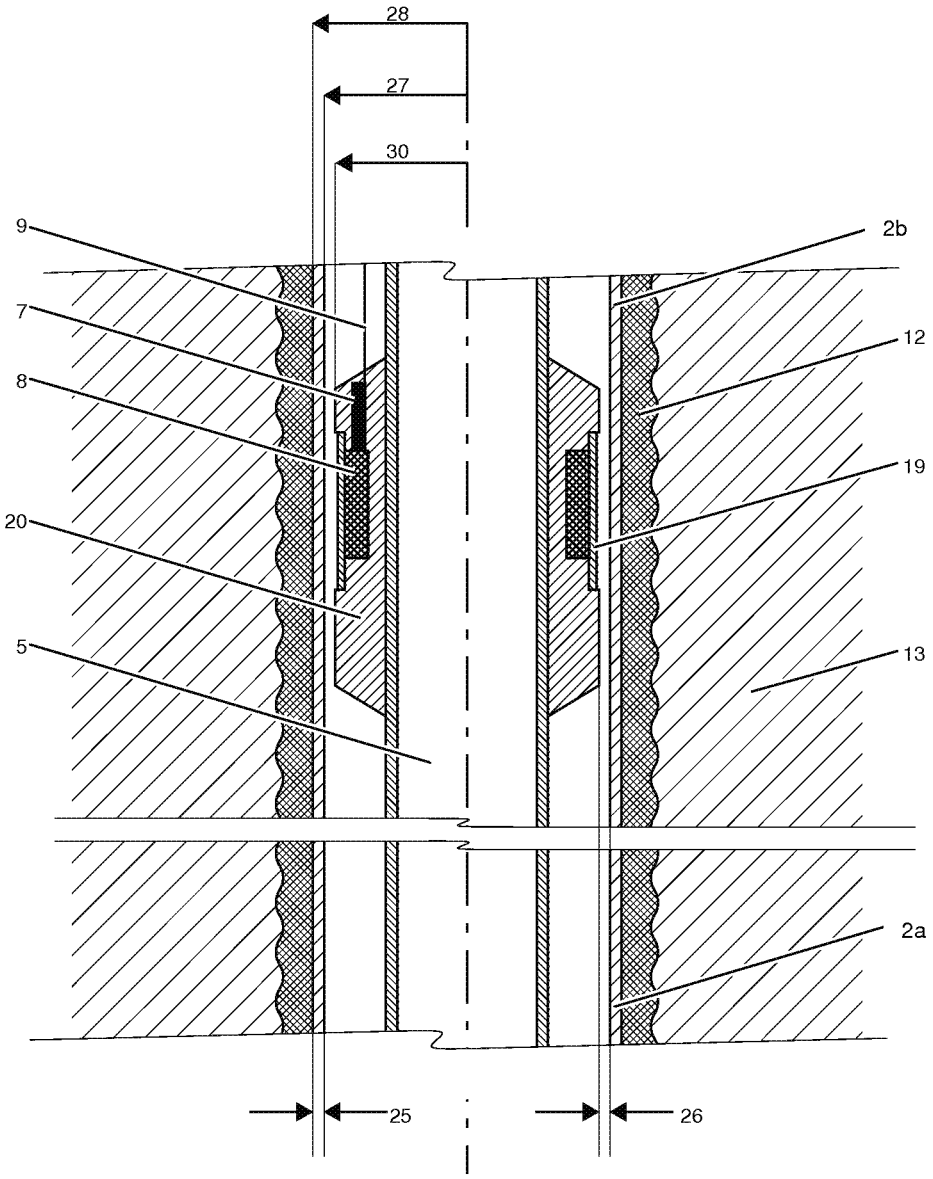
FIG. 6 is a section view of a wellbore casing and a wellbore completion comprising a tubular member with a magnetic dipole.

For the overview of the development of the well refer to FIG. 5 that gives an illustrative workflow of a method for aligning components in a well in a flow chart. The first step in the process is installation (101) of a wellbore casing (2) into the well. A second casing segment (2*b*), also named a signature segment is installed a distance called the remaining distance (10) from the desired landing depth (dl). The second casing segment (2*b*) should have a different magnetic permeability than the main casing and casing joints called first casing segments (2*a*). The remaining distance is recorded (102) and will be used later in the process to align the wellbore completion (5) with the wellbore casing (2). The wellbore casing (2) is terminated to the wellhead housing (1). The wellbore casing (2) program projects through a wellbore and formation (13) and is typically cemented (12) along its outer surface to up towards the wellhead housing (1).

The phase of running the final tubing assembly into the well is often referred to as running the wellbore completion. The wellbore completion (5) is a tubing assembly consisting of a bottom hole assembly, BHA (11) shown in FIG. 1, typically including a packer device (not shown). Above the BHA (11) a first completion magnetic dipole (8) is installed. In an embodiment the first completion magnetic dipole (8) is attached to a downhole cable (9) that may be run and clamped along the wellbore completion (5). The first completion magnetic dipole (8) is powered through downhole cable (9).

Then, the wellbore completion with the first completion magnetic dipole (8) is lowered (104) or run downhole the well and as the BHA (11) and first completion magnetic dipole (8) gets close to the location of the second casing segment (2*b*), equivalent relative permeability (32) may be monitored real-time, or continuously in order to do final in-well navigation.

Since the purpose of monitoring the magnetic permeability of the casing (2) is to detect a difference in magnetic permeability for the purpose of detecting the second casing segment (2*b*) or signature joint, the actual value of the magnetic permeability is not necessary. A parameter referred to as equivalent relative permeability (32) is therefore used to indicate that any value that changes according to sensed magnetic permeability may be used for the purpose of detecting a change in the magnetic permeability. The value of the equivalent relative permeability (32) may be a voltage, a current etc. that changes depending on the magnetic permeability of the casing wall outside the first completion magnetic dipole (8).

The lowering of the wellbore completion (5) will continue (105) until the signature section or the second casing segment (2*b*) is detected. As can be seen from FIG. 1 the measured equivalent relative magnetic permeability (32) of the wellbore will change as the first completion magnetic dipole (8) enters the second casing segment (2*b*). This is caused by change in property or shape of the surrounding wellbore casing (2). Seen from an electromagnetic perspective, the change in equivalent relative magnetic permeability (32) will alter the characteristics of the first completion magnetic dipole (8) as it enters the second casing segment (2*b*) or signature segment. Thus, using the first completion magnetic dipole (8) to monitor change in equivalent relative magnetic permeability (32) as the wellbore completion (32) is run downhole the well, the second casing segment (2*b*) will be automatically detected as the first completion magnetic dipole (8) gets into its proximity.

When the second casing segment (2*b*) has been detected, the current depth, or a space-out starting depth (d0) of the wellbore completion (5) is recorded. Since the remaining distance (10) between the second casing segment (2*b*) and the desired landing depth (dl) recorded earlier is known, the remaining distance can now be spaced out (107). This includes calculation of the number and lengths of first casing segments (2*a*) i.e. tubing and joints necessary to add up to the remaining distance (10). The calculation should take into account that tubing is usually available only in some fixed lengths.

The knowledge of the recorded remaining distance (10) and the detection of the signature joint or second casing segment (2*b*) can then be used to effectively and accurately space out the remaining distance (10) in order to align components whose relative position versus the second casing segment (2*b*) in the wellbore casing and relative position versus the first completion magnetic dipole (8) in the wellbore completion are known. The components will typically be two magnetic dipoles.

Ultimately the tubing hanger (6) is landed (108) in the wellhead housing (1) when all the tubing required for space-out has been added to the wellbore completion (5). The wellbore is now completed and the components in the well are aligned.

In an embodiment, a wellbore completion alignment method comprises the following operations:

- installation (101) of a wellbore casing (2) comprising two or more first casing segments (2*a*) with a first magnetic permeability (μ2*a*), and a second casing segment (2*b*) with a second magnetic permeability (μ2*b*) intermediate two of the first casing segments (2*a*),
- recording (102) a remaining distance (10) between the second casing segment (2*b*) and a landing depth (dl),
- assembling (103) a wellbore completion (5) comprising a first completion magnetic dipole (8) arranged for measuring a magnetic permeability (32) of the wellbore casing (2),
- lowering (104) the wellbore completion (5) downhole inside the wellbore casing (2), and during the lowering monitoring the measured magnetic permeability (32),
- continuing (105) the lowering until a first relative change in the measured magnetic permeability (32) from the first magnetic permeability (μ2*a*) to the second magnetic permeability (μ2*b*) is detected and recording (106) a space-out starting depth (d0) for the wellbore completion (5),
- spacing-out (107) the remaining distance (10) from the space-out starting depth (d0) to the landing depth (dl),
- landing (108) the wellbore completion (5) as terminated by a tubing hanger (6) in a wellhead housing (1).

Figure 2:
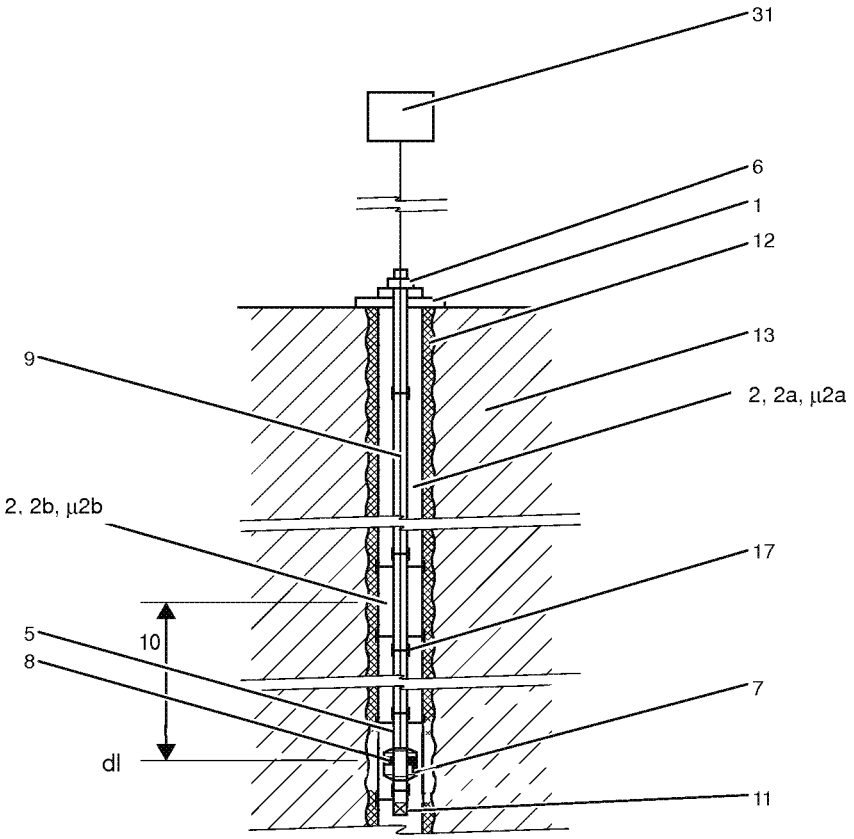
FIG. 2 is a section view of a well after completed alignment.

In FIG. 2 the aligned system according to this embodiment is illustrated. The first completion magnetic dipole (8) has now been lowered down to the landing depth (dl), and would therefore be aligned with a component, such as a sensor with a magnetic dipole at this level arranged fixed relative the casing (2). It should be noted that components or apparatuses arranged at a known distance from the first completion magnetic dipole (8) may be aligned with components or apparatuses arranged at a known distance from the second casing segment (2*b*) of the wellbore casing (2), since these distances will only be relative the known locations when the second casing segment (2*b*) has been detected.

According to this embodiment, the accurate landing depth (dl) is known when the second casing segment (2*b*) has been detected outside the first completion magnetic dipole (8) of the wellbore completion (5), and the necessary remaining space out can be calculated based on the remaining distance (10) and the current height of the wellbore completion above the wellhead housing (1). Necessary additional lengths of tubing can then be calculated for the space out and termination in the tubing hanger (6).

According to an embodiment, the operation of spacing-out (107) the remaining distance (10) comprises mounting additional first casing segments (2*a*) with a total length (tl) equal to the remaining distance (10) and lowering the wellbore completion (5) a distance equal to the remaining distance (10).

For exact alignment it may be necessary to verify the detection (105) of the second casing segment (2*b*) by lowering the wellbore completion (5) until a new change in equivalent magnetic permeability is detected on joint between the second casing segment (2*b*) and the lower second casing segment (2*a*). Since the length of the second casing segment (2*b*) is known from the installation (101) of the wellbore casing (2) it can now be verified that the distance between the first and second change in equivalent relative permeability is equal to the length of the second casing segment (2*b*). Such verification can accurately identify the position of the wellbore completion in the wellbore casing.

According to this embodiment, the method comprises the operation of continuing the lowering after detection of the first relative change in the measured magnetic permeability (32) until a second relative change in the measured magnetic permeability (32) from the second magnetic permeability (μ2*b*) to the first magnetic permeability (μ2*a*) is detected, and verifying that a length interval (li) of the lowering of the wellbore completion (5) from the first relative change to the second relative change in the measured magnetic permeability (32) is equal to a length of the second casing segment (2*b*).

If the position of the wellbore could not be sufficiently accurately identified in the previous operation, the wellbore completion may be somewhat lifted to identify the upper edge of the second casing segment (2*b*) and lowered once more to identify the lower edge. This can be repeated until it can be verified that the distance between the upper and lower change in equivalent relative permeability is equal to the length of the second casing segment (2*b*).

In this embodiment, the method comprises the operation of raising and lowering the wellbore completion until it can be verified that the length interval (li) of the lowering of the wellbore completion (5) from the first relative change to the second relative change in the measured magnetic permeability (32) is equal to a length of the second casing segment (2*b*).

The verification process of lifting the wellbore completion and lowering again and using the second casing segment (2*b*) as a reference point also has the advantage that the slack of the wellbore completion can be found and recorded. 6.

A Push-Pull test of the wellbore completion (5) when monitoring the relative changes in measured permeability (32) can be performed to establish the length of the slack or accumulated buckle to monitor downhole response to reverse and direct movement as manipulating the elevator, i.e. establish in-well dead band.

According to an embodiment the method comprises the operation of recording a slack of the wellbore completion (5) inside the wellbore casing (2), where the slack is a difference between an upper movement length and a lower movement length, where the lower movement length is the length of the second casing segment (2*b*) and the upper movement length is a vertical lift of the wellbore completion (5) measured above the wellhead housing (1) when the wellbore completion (5) is lifted a distance equal to second casing segment (2*b*) as measured by the second casing segment (2*b*) by raising and lowering the wellbore completion from the first relative change to the second relative change in the measured magnetic permeability (32).

Figure 3:
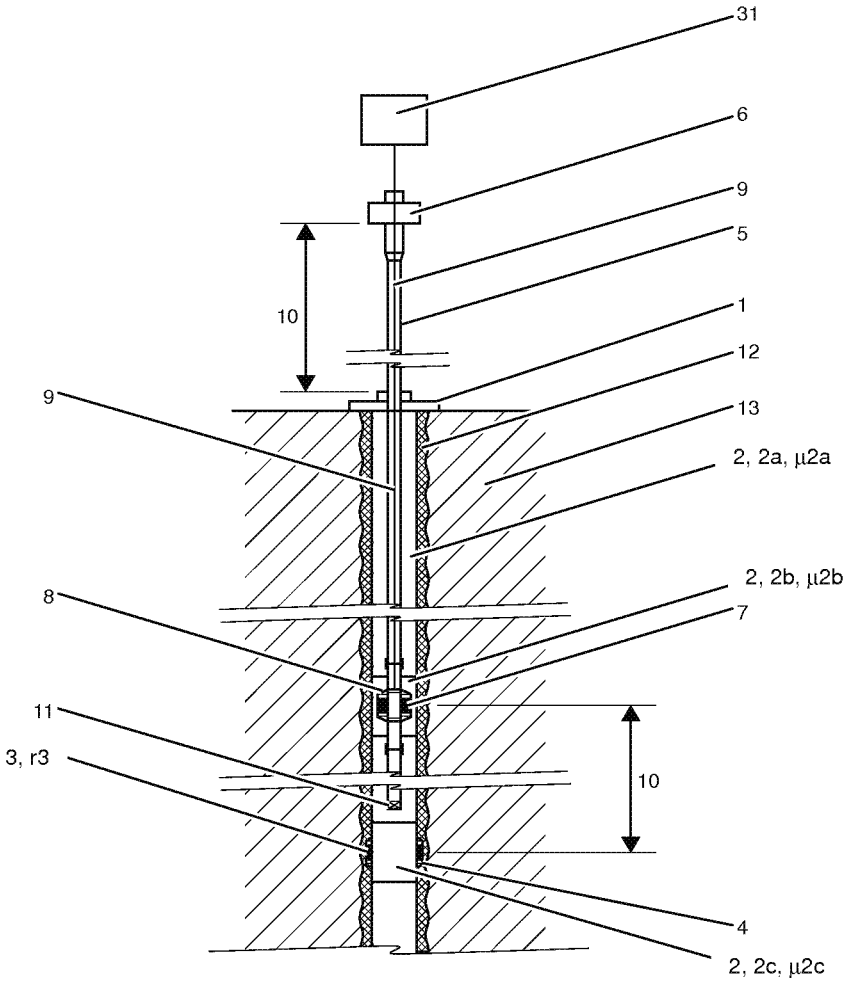
FIG. 3 is a section view of a well during well completion alignment, showing casing conveyed magnetic dipoles to be aligned with the tubing conveyed first completion magnetic dipole.

Referring now to FIG. 3, an embodiment of the invention targeted at alignment of magnetic dipoles as described above is shown. Here a first casing external magnetic dipole (3) is arranged in or external to the wellbore casing.

In this embodiment the wellbore completion alignment system comprises a first casing external magnetic dipole (3) arranged outside a third casing segment (2*c*) intermediate two first casing segments (2*a*) and below the second casing segment (2*b*), and the remaining distance (10) is equal to a distance between the second casing segment (2*b*) and the first casing external magnetic dipole (3).

The second casing segment (2*b*) which in this embodiment may also be called a "Signature Joint" has a different relative magnetic permeability than the plurality of casing joints. It is attached to the wellbore casing (2) program run at a specific known position. This position in the well can be defined as a reference or index point and the second casing segment (2*b*) being the well index marker. Hence, the signature joint will provide as an index and will indicate a particular distance to/from a component or apparatus, such as a magnetic coupler that needs to be aligned with in the well. Thus, as the well completion (tubing) is run downhole the well, an apparatus of the invention will continuously measure the (equivalent) relative magnetic permeability of the wellbore. As the apparatus gets in proximity of the second casing segment (2*b*) it will measure a change in equivalent relative permeability of the wellbore, of which is an indication the completion reached the index marker, e.g. the second casing segment (2*b*). In turn, this information accurately indicates the remaining distance (10) to the target casing external magnetic dipole (3). Thus, a correct space-out for the remaining tubing to tubing hanger attachment may be calculated so the magnetic couplers will be properly aligned as the well completion lands in the wellhead housing.

Figure 4:
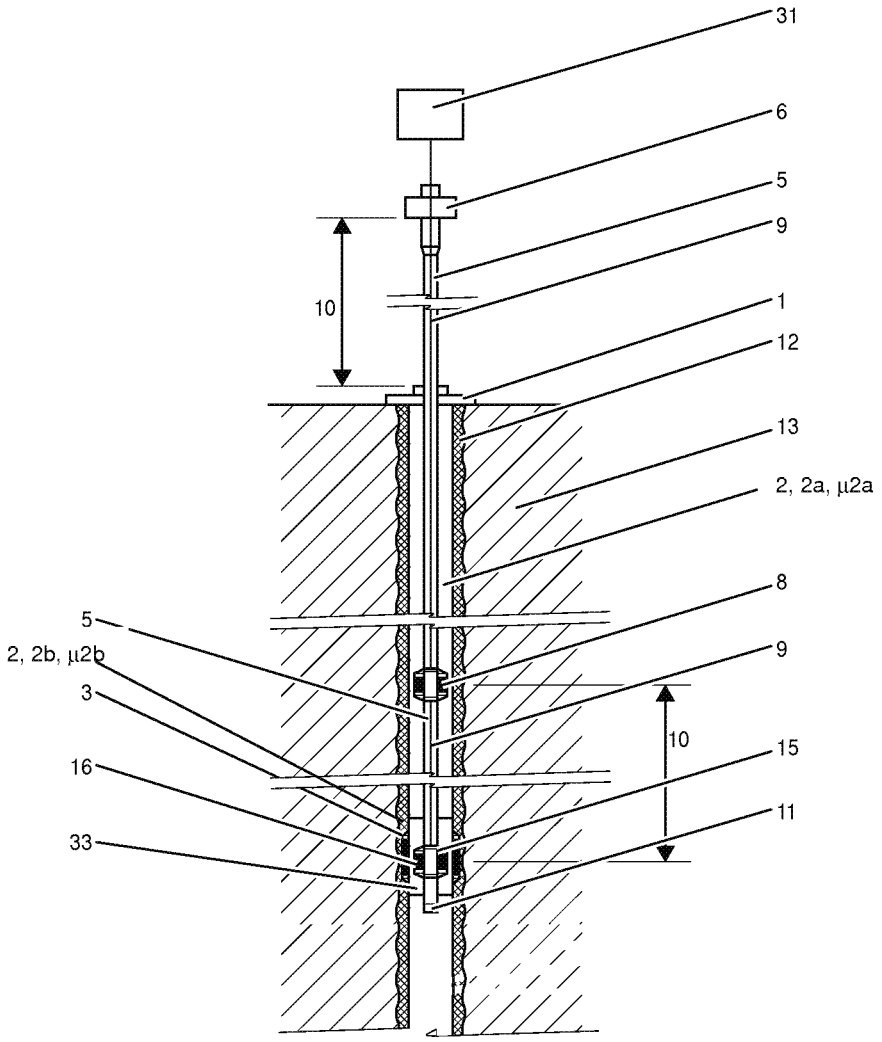
FIG. 4 is a section view of a well during well completion alignment, showing casing conveyed magnetic dipoles to be aligned with the tubing conveyed first completion magnetic dipole and the use of a homer device.

According to the invention, sensors are allowed to be placed in-situ formation and are wirelessly hosted from inside the wellbore without a cable or a cord to power and communicate. In an embodiment, FIG. 4 shows a wellbore casing (2) and wellbore completion (5) program typically run in two independent operations into the well, a second completion magnetic dipole (16) is arranged below the first completion magnetic dipole (8) to navigate in the well so the target magnetic dipoles, i.e. the first completion magnetic dipole (8) and the first casing external magnetic dipole (3) are aligned to achieve connectivity as the wellbore completion (5) is landed and hung off by the tubing hanger (6) in the wellhead housing (1).

The second completion magnetic dipole (16) may be arranged in any location along the wellbore completion (5) tubing length, but for the purpose of this invention in a particular slot so that it assists in spacing-out the final joint prior to attaching the tubing hanger (6). In turn, this enables the first casing external magnetic dipole (3) and first completion magnetic dipole (8) get in close proximity as the wellbore completion (5) is landed.

In an embodiment, the second completion magnetic dipole (16) comprised in a homer device (15) fixed to the wellbore completion and attached to the downhole cable (9) which in turn is run along the wellbore completion (5) to the surface of the earth and attached to the surface device (31). The homer device (15) comprises processing electronics connected to the second completion magnetic dipole (16) and to the downhole cable (9).

For the initial phase of running the wellbore completion (5) downhole the well, surface device (31) works as a proximity readout device to detect as the homer device (15), and thus the second completion magnetic dipole (16) is aligned with the third casing segment (2*c*) and casing external magnetic dipole (3).

To detect that the wellbore completion (5) is in the particular position where the homer device (15) is aligned with the third casing segment (2*c*) and casing external magnetic dipole (3), the homer device (15) processing electronics may typically be utilized in one out of the following two ways:

In an embodiment, the proximity of third casing segment (2*c*) and casing external magnetic dipole (3) is monitored by measuring the (equivalent) relative magnetic permeability, which will change as the homer device (15) enters the non-magnetic third casing segment (2*c*).

In another embodiment, a call message is send out from the homer device (15) as the wellbore completion (5) is run into the wellbore casing (2) and a response is sent from the remote casing external magnetic dipole (3) and casing external apparatus (4) on the outside of third casing segment (2*c*), when the homer device (15) and the casing external magnetic dipole (3) get into proximity and connectivity is establish. In this embodiment, the functionality of the casing external magnetic dipole (3) and casing external apparatus (4) may also be verified. In an embodiment, the two embodiments are combined to first measuring the (equivalent) relative magnetic permeability to detect the third casing segment (2*c*), and then sending out the call message to verify that the functionality of the casing external magnetic dipole (3) and casing external apparatus (4) are working according to expectations.

However, as proximity or connectivity is detected, the operators get feedback from surface device (31) that the two units in the well are aligned and this way enable them to accurately establish the remaining distance (10) of the wellbore completion (5) to be assembled before terminating and hanging off the wellbore completion (5) by the tubing hanger (6). This way the homer device (15) will efficiently and accurately ensure that the magnetic couplers in the well will be aligned and engaged as the wellbore completion (5) is brought to its final configuration.

Now refer to FIG. 4 showing the installation with the homer device (15) in more detail. The wellbore completion (5) is a tubing assembly consisting of a bottom hole assembly (BHA) (11) that typically include a packer device, not shown. Above the BHA (11), the homer device (15) is mandrel attached to the wellbore completion (5) and comprises processing electronics for electrically processing and powering the second completion magnetic dipole (16). The homer device (15) may also include sensors for sensing one or more annular space or tubing related parameters, or the integrity of either off.

According to an embodiment, a wellbore completion alignment system as illustrated in FIGS. 1 and 2, comprises:

- a wellbore casing (2) comprising two or more first casing segments (2*a*) with a first magnetic permeability (μ2*a*), and a second casing segment (2*b*) with a second magnetic permeability (μ2*b*) different from the first magnetic permeability (μ2*a*) arranged intermediate two of the first casing segments (2*a*),
- a wellbore completion (5) comprising a first completion magnetic dipole (8) arranged for measuring a magnetic permeability (32) of the wellbore casing (2),
- a surface device (31) arranged for recording a remaining distance (10) between the second casing segment (2*b*) and a landing depth (dl), and for monitoring the measured magnetic permeability (32) when lowering the wellbore completion (5), and
- a tubing hanger (6) in a wellhead housing (1) arranged for landing the wellbore completion (5) as terminated after alignment.

The components of the system have been described above for the corresponding method.

According to an embodiment illustrated in FIG. 3, the wellbore completion alignment system comprises a first casing external magnetic dipole (3) arranged outside a third casing segment (2*c*) with a third magnetic permeability (μ2*c*) different from the second magnetic permeability (μ2*c*) arranged intermediate two first casing segments (2*a*) and below the second casing segment (2*b*), where the remaining distance (10) is equal to a distance between the second casing segment (2*b*) and the first casing external magnetic dipole (3).

According to an embodiment, the wellbore completion alignment system comprises a first casing external magnetic dipole (3) arranged outside the second casing segment (2*b*), and the wellbore completion (5) comprising a second completion magnetic dipole (16) below the first completion magnetic dipole (8), and where the remaining distance (10) is equal to a distance between the first completion magnetic dipole (8) and the a second completion magnetic dipole (16).

In an embodiment, the wellbore completion alignment system comprises the homer device (15) holding the second completion magnetic dipole (16) as described above In one or more of the embodiments described herein, the second casing segment (2*b*) or Signature Joint has different magnetic permeability than the magnetic permeability of the remaining first casing segments (2*a*) of the wellbore casing (2).

The second casing segment (2*b*) may be slightly different designed than the plurality of first casing segments (2*a*), which includes tubes and joints. In an embodiment the second casing segment (2*b*) has a wall thickness (25) different from a wall thickness of the first casing segments (2*a*) as illustrated in FIG. 8.

FIGS. 8 thru 11 show examples of different configurations of the second casing segment (2*b*). In principle, the second casing segment (2*b*) is configured to be seen different from the first casing segments (2*a*), including the joints attached above and below it. One way to achieve this is by shaping the exterior and/or interior of the second casing segment (2*b*), respectively. For example, the latter may be achieved by resizing the second casing segment (2*b*) making the interior radius (27) smaller or bigger, or simply by adding more goods to the exterior wall of the conduit by increasing the exterior radius (28).

In an embodiment, the second casing segment (2*b*) has an interior radius (27) and/or an exterior radius (28) different from a respective interior radius and exterior radius of the first casing segments (2*a*).

Figure 8:
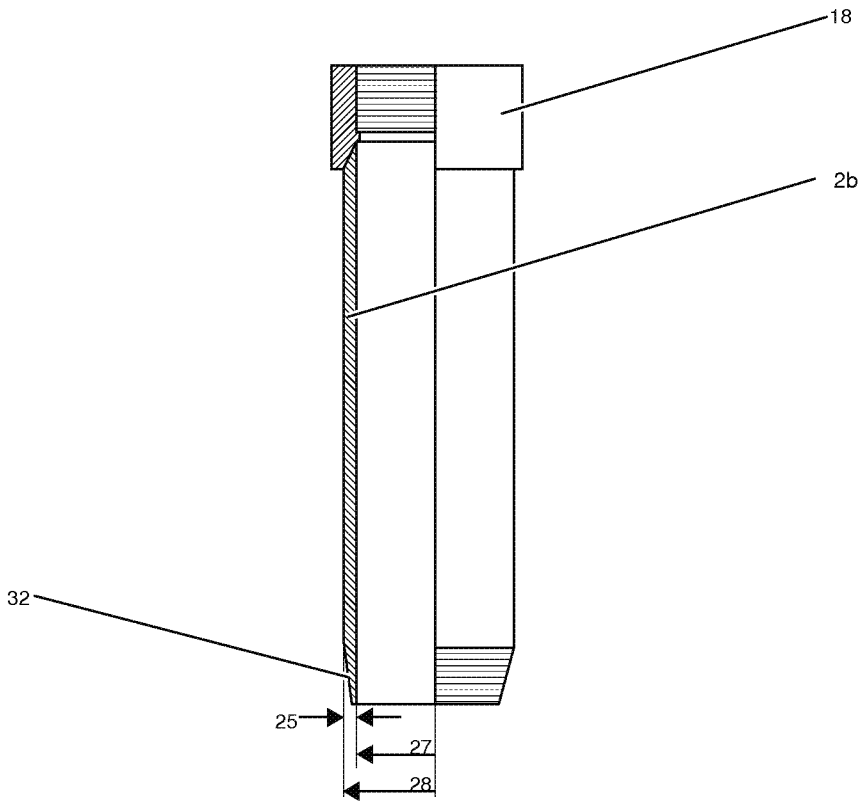
FIGS. 8 to 11 shows in section views different embodiments of signature joints.

As shown in somewhat greater detail in FIG. 8, a second casing segment (2*b*) in a traditional pin-pin with collar (18) layout having the same interior radius (27) and the same wall thickness (25) made as the rest of the wellbore casing (2) program but made in a material having a different magnetic permeability (32).

Figure 9:
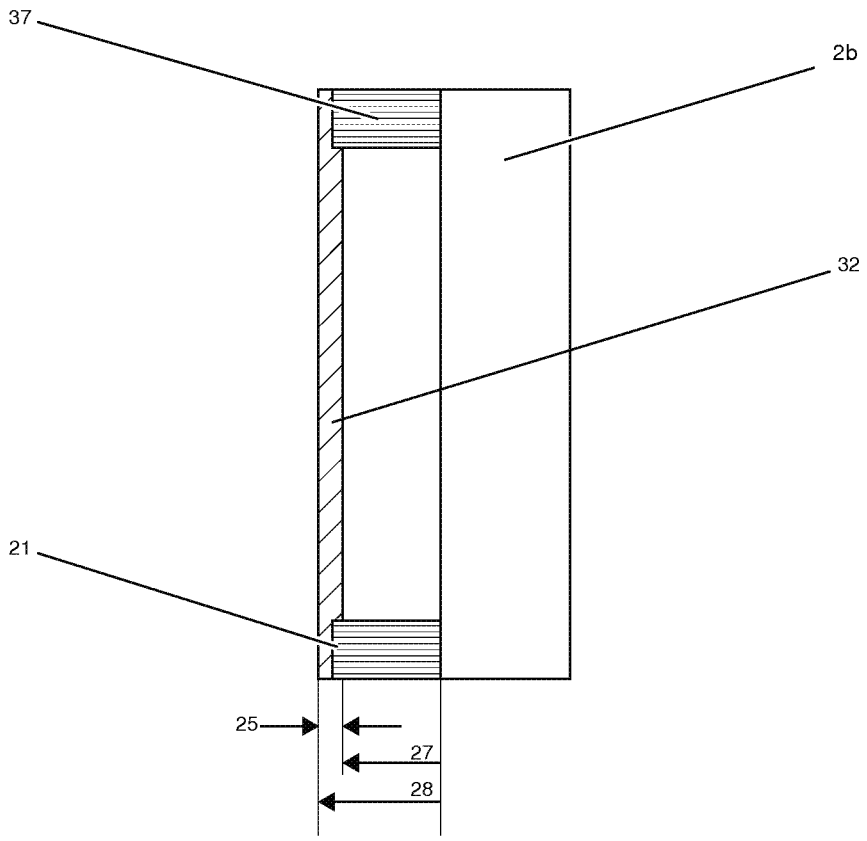

FIG. 9 illustrates an alternative second casing segment (2*b*) having a box-box configuration and made in a material having different magnetic permeability (32) than the wellbore casing (2) program.

Figure 10:
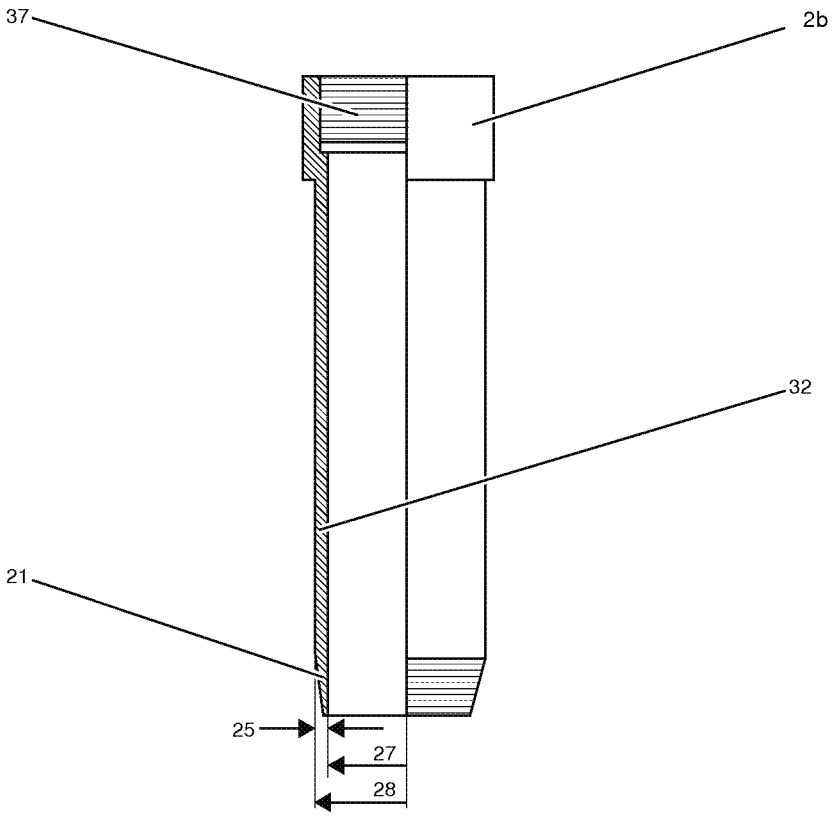

FIG. 10 shows a box-pin configuration second casing segment (2*b*) having the same wall thickness (25) and interior radius (27) as the wellbore casing (2) but made in a material having different magnetic permeability (32).

In an embodiment the second casing segment (2*b*) is made in a material with different magnetic permeability (32) than a magnetic permeability of a material of the first casing segments (2*a*).

Figure 11:
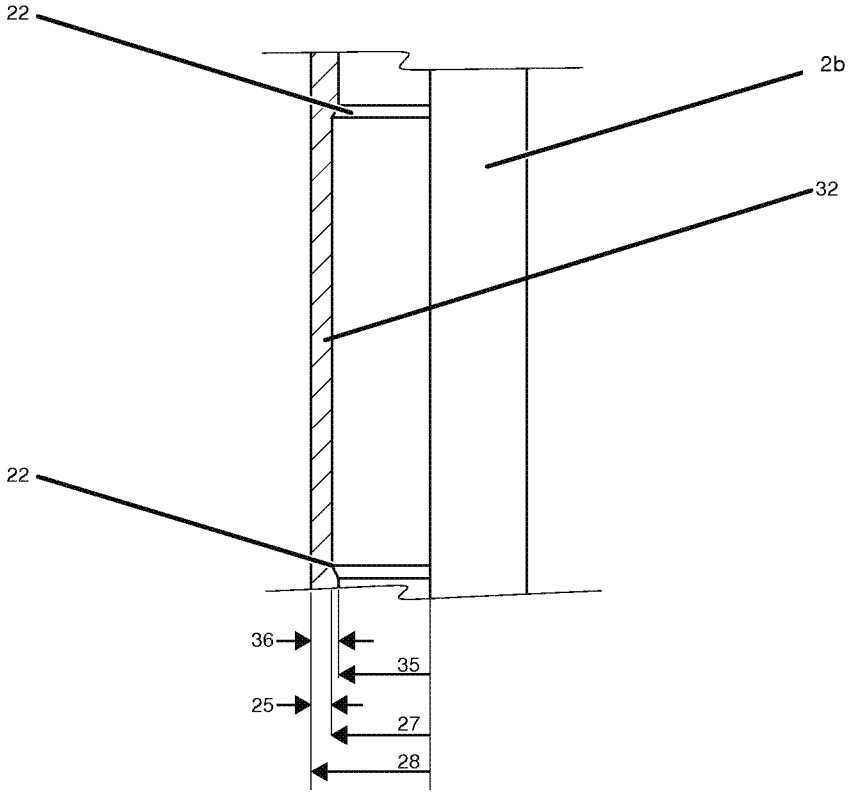

FIG. 11 shows an alternative second casing segment (2*b*) which has a recess (22) that increases the interior radius (27). To withstand the strength of the second casing segment (2*b*) due to recess (22), the wall thickness (25) may be changed, or the material tempered to make the joint or joint material stronger. The main purpose is that the recess (22) makes the interior radius (27) larger than the other first casing segments (2*a*), including the joints casing joints. Consequently, the propagation of an internally induced magnetic field, as compared to field propagation in the first casing segments (2*a*) will be different. Further, the recess (22) makes it possible to make the second casing segment (2*b*) in a material that is similar to the plurality of casing joints in the first casing segments (2*a*) and still obtain a different magnetic permeability (32).

In an embodiment, the second casing segment (2*b*) has a wall thickness (25) different from a wall thickness of the first casing segments (2*a*).

It should be understood that all the embodiments described above for the casing segment (2*b*) may be used and combined with the different embodiments of the method and system for alignment of the wellbore completion according to the invention.

The radiation of a magnetic dipole is proportional to the magnetic dipole momentum, i.e., proportional to the $H_z$ field at the casing centre. When the magnetic dipole, e.g. the first completion magnetic dipole (8) is inside the wellbore casing (2), the field $H_z$ is composed of two parts: $H_z$ generated by the coil and $H_z$ reflected at the inner casing surface. Apparently the reflected $H_z$ changes with the relative magnetic permeability and the thickness of the casing. We use '(equivalent) relative permeability' to characterize the combination of the two parameters. Hence, the momentum of the magnetic dipole is a function of the equivalent relative permeability of the surrounding wellbore casing. The principle described here of how to affect the momentum characteristics of an electrically energized magnetic dipole inside a wellbore casing is used to accurately space out a wellbore completion for the present invention.

Figure 12:
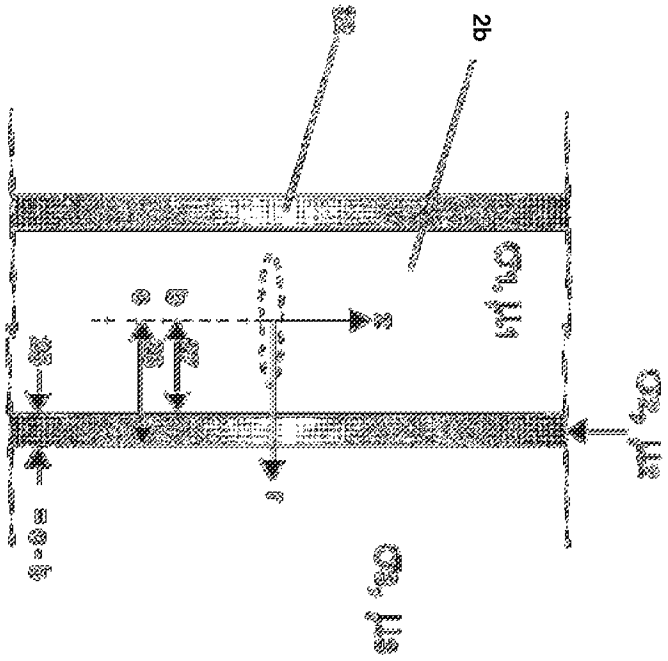
FIG. 12 is a cross sectional view to identify the magnetic field induced by the magnetic dipole as well as the parameters that effects its propagation.

Consider the model shown in FIG. 12, where:

- z is the vertical axis, r or x is the radial axis
- a coil, e.g. the first completion magnetic dipole (8), generates $H_z$ in z direction First we compare casing attenuation for casing with different magnetic permeability (32), which is the μvalue.

Figure 13:
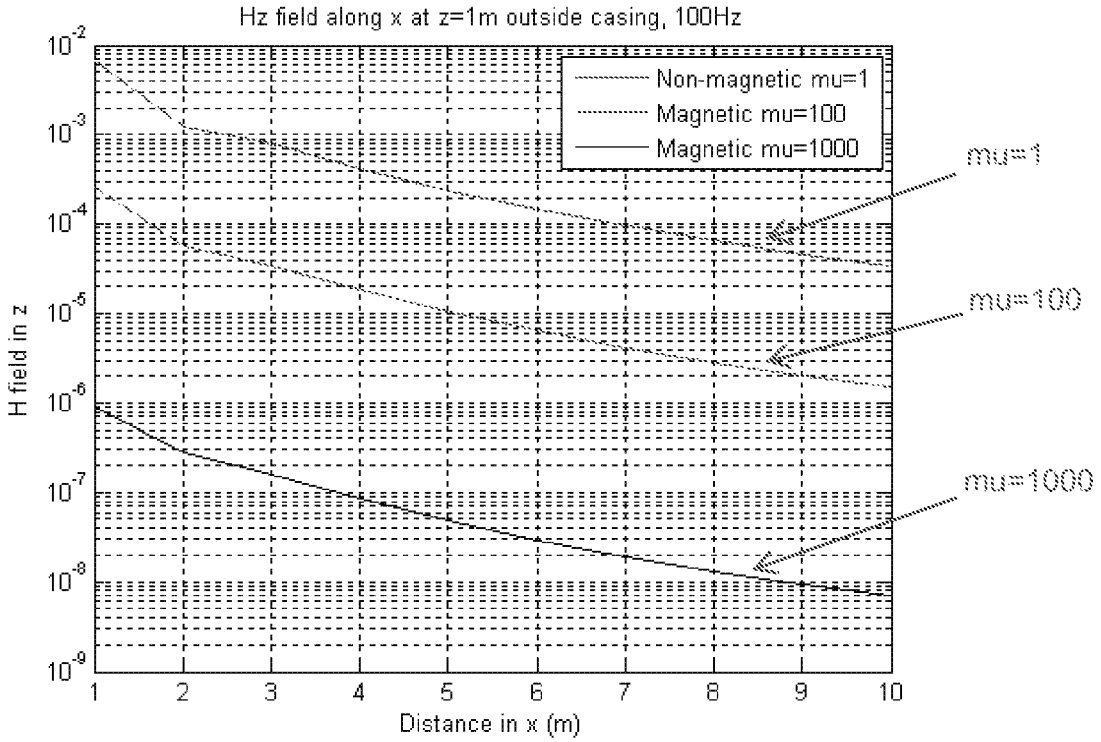
FIGS. 13 to 16 are diagrams showing the attenuation of the magnetic $H_z$ field as induced by internally mounted dipole through wellbore casing of different magnetic permeability.

The following parameters defined in FIG. 12 are used for this calculation where σ1 and μ1 is the conductivity and permeability inside the casing, σ2 and μ2 is the conductivity and permeability in the casing wall, σ3 and μ3 is the conductivity and permeability outside the casing, and b and c is the inner and outer radius (27, 28) of the casing, respectively:

a. μ1=μ3=1, and μ2=1, 100, 1000 respectively;
b. σ1=0.5 S/m, σ2=5×106, σ3=1 S/m;
c. b=10 cm
d. c=11 cm
e. f=100 $H_z$ FIG. 13 shows the calculated $H_z$ field versus x, outside the casing at z=1 m, for $\mu_2$=1, 100, 1000 respectively.

Figure 14:
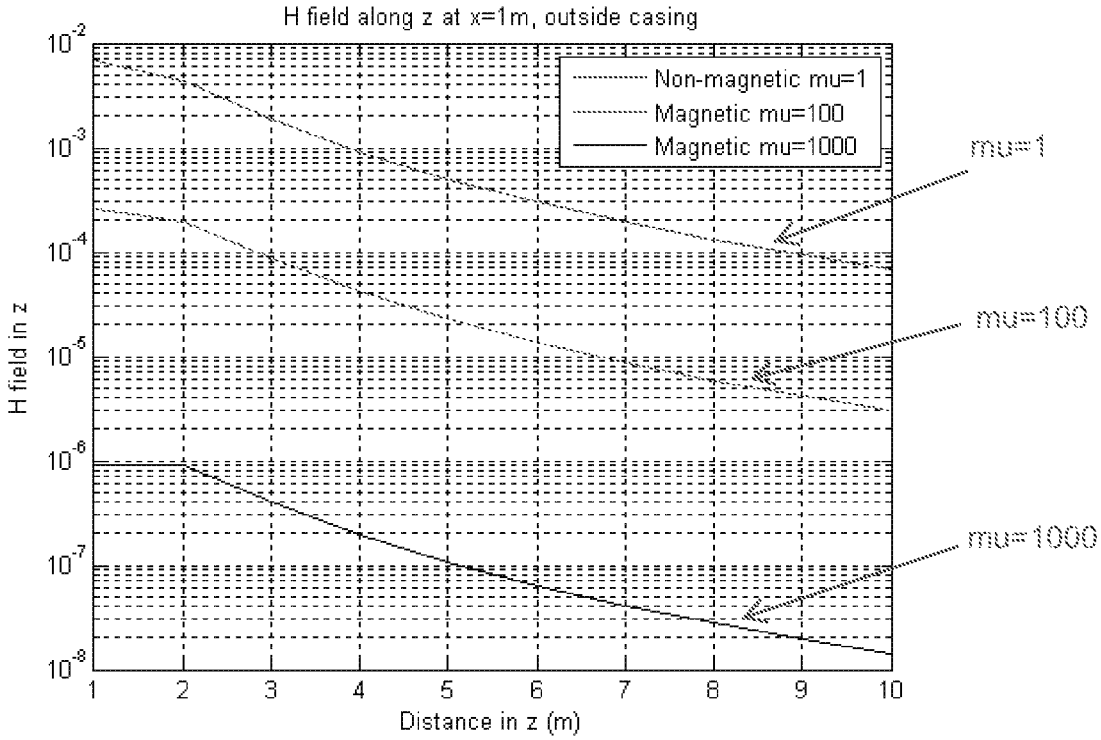

FIG. 14 shows the calculated $H_z$ field versus z, outside the casing at x=1 m, for $\mu_2$=1, 100, 1000 respectively.

Both figures show that the attenuation of casing is the smallest for magnetic permeability $\mu_2$=1 (non-magnetic casing 14), and increases when $\mu_2$ increase (above 1.0011).

Figure 15:
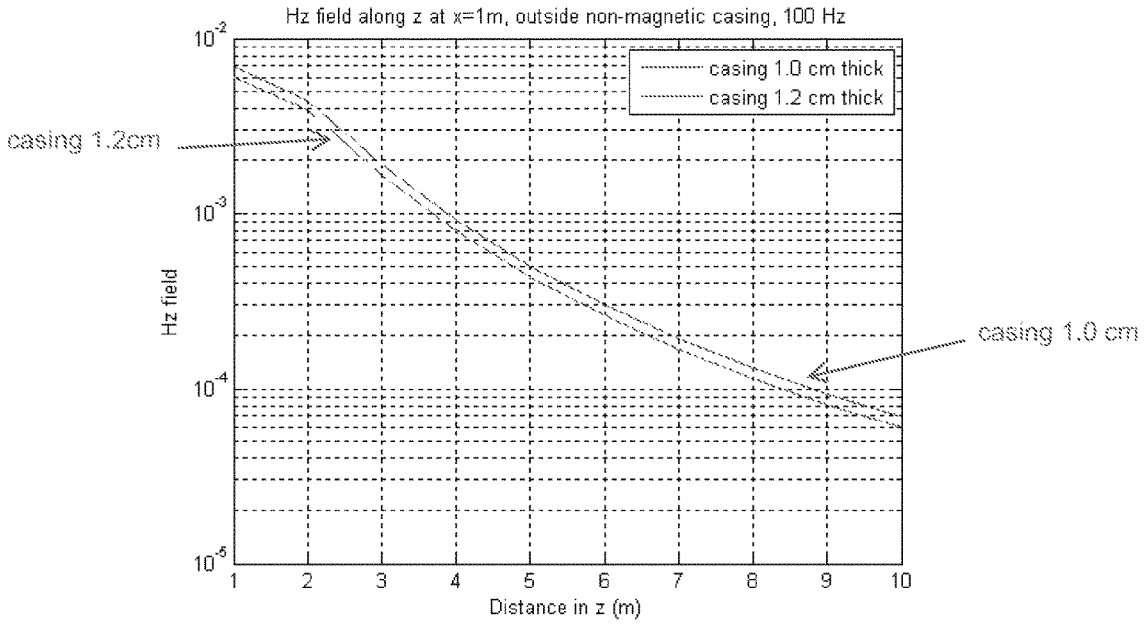
Figure 16:
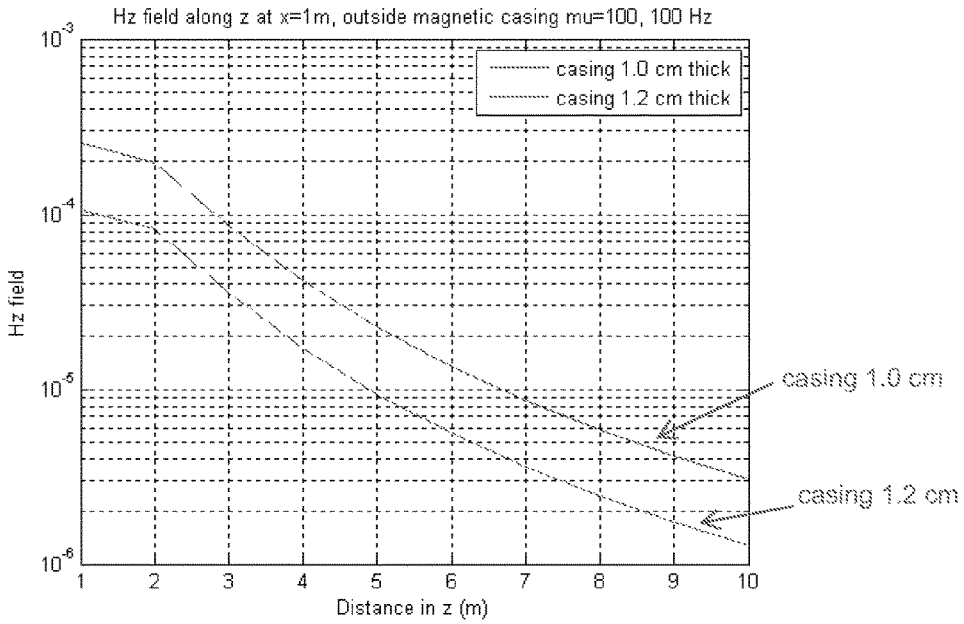

Next we choose to compare casing attenuation for casing with different wall thickness (25) based on the following values:

f. μ1=μ2=μ3=1;
g. σ1=0.5 S/m, σ2=5×106, σ3=1 S/m;
h. b=10 cm and 9.8 cm respectively
i. c=11 cm
j. f=100 $H_z$ FIG. 15 shows the calculated $H_z$ field versus z, outside a non-magnetic casing as the second casing segment (2*b*) at x=1 m for b=10 cm and 9.8 cm, corresponding wall thickness (25) of 1 cm and 1.2 cm respectively. FIG. 16 is the same calculation for a magnetic casing 2 of $\mu_2$=100.

FIGS. 15 and 16 shows that the attenuation caused by the casing gets smaller as the wall thickness (25) of the casing decreases. In the calculation, we have changed the interior radius (27) for changing the wall thickness (25). Hence this model also verifies the effect of varying the interior radius (27).

Figure 7:
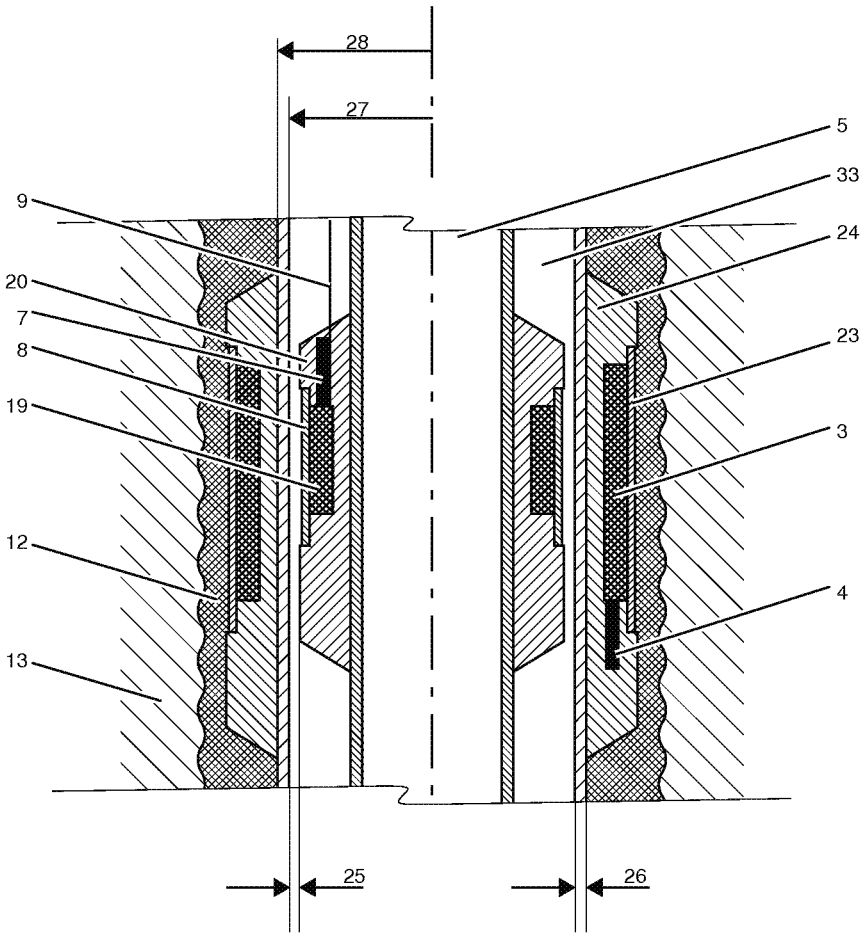
FIG. 7 is a section view of a wellbore casing with an external magnetic dipole and a wellbore completion comprising a tubular member with a magnetic dipole.

In an embodiment, the first completion magnetic dipole (8) is made on a coaxially arranged tubular completion member (20) as illustrated in FIG. 7. The tubular completion member (20) is made in a magnetic material, and it acts like a core for the first completion magnetic dipole (8) and is arranged and fixed to the tubing of the wellbore completion (5). In turn, the first completion magnetic dipole (8) is an inductive coil that is axially wound over a section of the core or tubular completion member (20) and sealed into a closed containment by a completion sealing member (19). When a current is passed in the electric coil, it induces magnetic field $H_z$ in the axial direction, please refer to FIG. 13. We may say that the coil is a magnetic dipole and the field it generates is a TE field. Typically, the completion sealing member (19) is made in a non-magnetic material and thereby transparent for the magnetic field induced by the first completion magnetic dipole (8) without gross attenuation.

In this embodiment, the wellbore completion comprises an external tubular member (20) fixed to the wellbore completion (5), wherein the first completion magnetic dipole (8) is an inductive coil axially wound around the external tubular member (20).

In turn, the first completion magnetic dipole (8) is attached to the cable (9) that run along the wellbore completion (5) to surface of the earth and provides for readout and recording of data in the surface device (31) shown in FIG. 1. In this embodiment, the wellbore completion alignment system comprises a cable (9) between the tubular member (20) and the surface device (31), wherein the cable is arranged for providing electric power from the surface device (31) to the first completion magnetic dipole (8) and providing electric measurements signals from the first completion magnetic dipole (8) to the surface device (31). In an embodiment, the cable (9) is further connected to the second completion magnetic dipole (16) and arranged for providing electric power from the surface device (31) to the second completion magnetic dipole (16) and providing electric measurements signals from the second completion magnetic dipole (16) to the surface device (31).

In FIG. 4, it is shown that the cable (9) is routed along the wellbore completion (5) down to the second completion magnetic dipole (16) or homer device (15) through or via the first completion magnetic dipole (8) and completion apparatus (7). This routing as shown is not a necessity for this invention. The first completion magnetic dipole (8) and homer device (15) may be wired up as illustrated sharing a common wiring network or bus or be routed independently from the homer device (15) to the surface device (31) by providing separate wiring or cable. Furthermore, the homer device (15) may, in an embodiment, include a permanent type pressure and/or temperature gauge configured to monitor the pressure and/or temperature inside or outside of the wellbore completion (5) to which it is attached. In this application, the homer device (15) would typically be an integrated part of the wellbore completion (5) and not a mounted mandrel as here illustrated.

In an embodiment, the cable (9) and the first completion magnetic dipole (8) is connected to a completion apparatus (7) which comprises an electronic section for electrically processing and powering the first completion magnetic dipole (8), as well as a sensor section for sensing one or more parameters of the wellbore or integrity of the members to which it is attached.

In theory and practice, the placement of the tubular completion member (20) can be anywhere along the wellbore completion (5) but in an embodiment, as shown in FIG. 3, it is placed at a position in the well so that it will be aligned with a mating first casing external magnetic dipole (3) as the wellbore completion (5) is hung off by the tubing hanger (6) in the wellhead housing (1).

In one embodiment, a third casing segment (2*c*) is supporting or housing the first casing external magnetic dipole (3) and casing external apparatus (4). In this embodiment, the third casing segment (2*c*) may be made in a non-magnetic material like Inconel 718 or 316, typically with a magnetic permeability of less than 1.1.

With reference to FIG. 7, it is illustrated an embodiment where first casing external magnetic dipole (3) is wound on a coaxial arranged mandrel or tubular casing member (24).

In this embodiment, the tubular casing member (24) is mounted to the outside of a third casing segment (2*c*) and both the tubular casing member (24) and the tubular casing member (24) are made in a material having a very low magnetic permeability e.g., equal or close to non-magnetic. Thus, the tubular casing member (24) and third casing segment (2*c*) become magnetically transparent, enabling the internal $H_z$ field generated by first completion magnetic dipole (8) to be picked up by the first casing external magnetic dipole (3) without gross attenuation. On the contrary, if tubular casing member (24) and third casing segment (2*c*) were made in a magnetic material having a magnetic permeability greater than 1.1 this would dramatically attenuate the field and the members would provide as a magnetic shield, protecting the first casing external magnetic dipole (3) from seeing the alternating magnetic field as generated by first completion magnetic dipole (8).

As with the first completion magnetic dipole (8), the first casing external magnetic dipole (3) is an inductive coil, and it is axially wound over a section of a tubular casing member (24) and sealed into a closed containment by a casing sealing member (23).

When the inductive coil of the first casing external magnetic dipole (3) is exposed to an alternating magnetic field from the inductive coil of first completion magnetic dipole (8), it converts the magnetic field into a voltage output. Thus, first casing external magnetic dipole (3) harvests energy from an artificial magnetic field induced by first completion magnetic dipole (8) and converts it to electric energy to support a connected casing external apparatus (4).

The casing sealing member (23) is mainly for the protection of the first casing external magnetic dipole (3) and can be made in a material having magnetic or non-magnetic material property. Further, casing sealing member (23) needs to be made in an in-well corrosion resistant material to protect the coil over prolonged periods of time in the well or formation (13).

In an embodiment, the casing external apparatus (4) comprises an electronic section for electrically processing and managing the power harvesting of the first completion magnetic dipole (8) as well as a sensor section for sensing one or more parameter of the formation (13), integrity of cementing (12), or the integrity of the tubular members of which it is attached, i.e. the wellbore casing (2) comprising first casing segments (2*a*) and the third casing segment (2*c*).

The first casing external magnetic dipole (3) is, in an embodiment, part of the wellbore casing (2) program or liner attached to a casing external apparatus (4) for electrically processing the power harvesting and communication to the first completion magnetic dipole (8) through the first casing external magnetic dipole (3).

In one embodiment, the casing external apparatus (4) comprises sensor electronics and one or more sensors to sense parameters of the surrounding cementing (12) and formation (13) or integrity of the wellbore casing (2) or a combination thereof. Furthermore, the third casing segment (2*c*) hosting the first casing external magnetic dipole (3) should be made in a non-magnetic material to be transparent for the magnetic field $H_z$ generated by the first completion magnetic dipole (8).

For transmittal of data or measurements, the casing external apparatus (4) communicates with the first completion magnetic dipole (8) thru the first casing external magnetic dipole (3). In turn, the first completion magnetic dipole (8) and completion apparatus (7) relays the data to the surface of earth via a cable (9) connection to a surface device (31) for monitor and/or readout. Finally, in theory and practice the placement of the third casing segment (2*c*) can be anywhere along the wellbore formation (13).

The third casing segment (2*c*) is usually arranged in a location where it is natural to monitor one of the parameters mentioned above or simply to monitor annular integrity between two adjacent tubular members in the well. In an embodiment, the third casing segment (2*c*) is arranged very near (under) the wellhead housing (1) for an annular pressure/temperature monitor application.

In another embodiment, inductive properties may be used to position a wellbore completion string.

Figure 17:
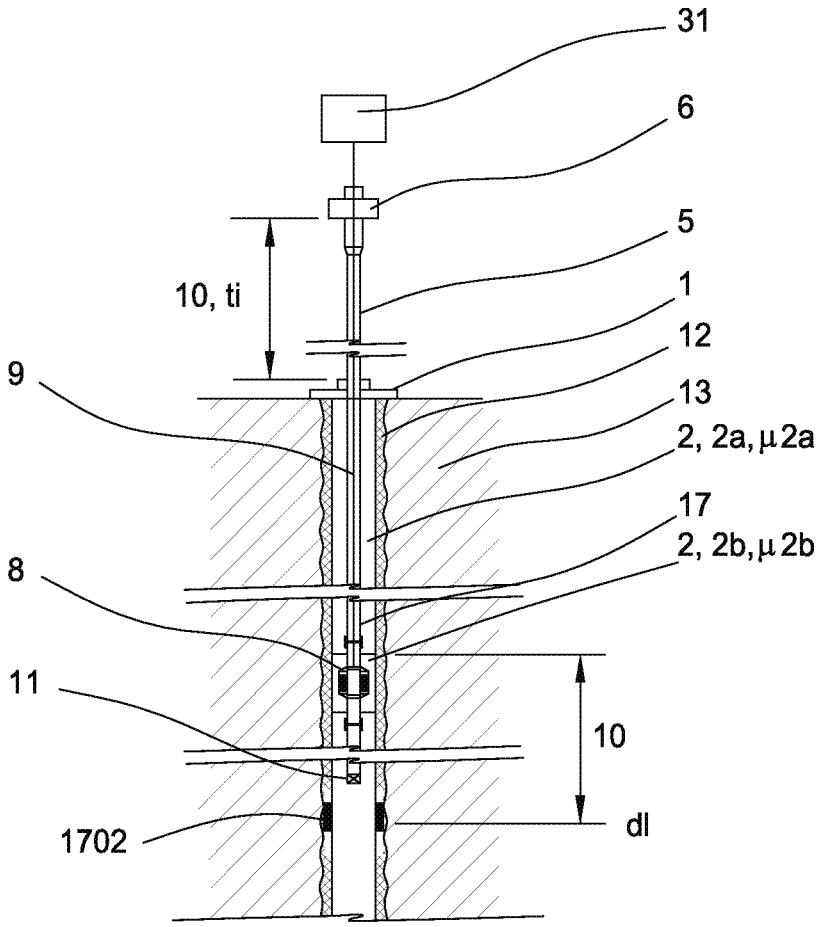
FIG. 17 illustrates a typical well with wellbore casing and the deployment of a wellbore completion string, according to an embodiment of the present invention.

FIG. 17 illustrates a typical well with wellbore casing (2) and the deployment of a wellbore completion string (5), according to an embodiment of the present invention. The well with the wellbore casing (2) is terminated by wellhead housing (1). The wellbore casing (2) projects through a formation (13) and is typically cemented (12) along its outer surface up to the wellhead housing (1). The wellbore casing segment includes at least first casing segments (2*a*) that are typically pipes or tubes of different length that are interconnected by casing joints (17). For the purpose of this invention, the standard casing joints (17) are considered part of the casing segments (i.e., a casing segment (2*a*) may consist of one or more tubes and joints). While the invention is described using jointed tubulars as examples, it is equally applicable to continuous tubing (e.g. Continuous coiled tubing or tubing lengths which are joined by welding or similar processes).

At a particular location in the well, the wellbore casing (2) is provided with a second casing segment (2*b*) also called the signature segment. The second casing segment (2*b*) is located and placed such that the top of the second casing segment (2*b*) is a remaining distance (10) from a landing depth (dl). (While reference is made to measurement relative to the top of the segment, it is to be understood that the origin of the measurement may be any location which is known relative to the location of an element which is identified by its inductive properties.) The magnitude of the remaining distance (10) depends on the type of well and how the well is accessed. Typically the remaining distance (10) will be larger for a well operated from a vessel than a fixed land or platform well. Compared to the first casing segment (2*a*), the second casing segment (2*b*) may have a difference in thickness, a difference in radii, or a difference in magnetic permeability. For example, the first casing segment (2*a*) may have a first magnetic permeability ($\mu$2*a*) and the second casing segment (2*b*) may have a second magnetic permeability ($\mu$2*b*). For certain aspects, the differences between the first and second casing segments may involve shaping the exterior and/or interior of the second casing segment (2*b*). Shaping may involve resizing the second casing segment (2*b*), making the interior radius smaller or bigger, or adding material to the wall of the conduit by increasing the exterior radius or decreasing the interior radius. For certain embodiments, the first and second casing segments may have similar characteristics, but the second casing segment (2*b*) may include an inductive element or a permanent magnet.

During the wellbore completion program, the wellbore completion string (5) is inserted inside the wellbore casing (2) as can be seen from FIG. 17. Tubes and joints are continuously added to make the wellbore completion string (5) longer as it penetrates deeper and deeper into the wellbore casing (2).

FIG. 17 further illustrates the wellhead housing (1) and the tubing hanger (6), and the bottom hole assembly (11) as the bottom most component of the wellbore completion string (5).

The wellbore completion string (5) also includes an inductive element (8) that may be coaxially positioned on an outside surface of the wellbore completion string (5). For certain aspects, the inductive element (8) may be axially wound over a section of the wellbore completion string (5) and sealed into a closed containment by a completion sealing member. The completion sealing member may be made of a non-magnetic material and, thereby, transparent for magnetic fields induced by the inductive element (8). The inductive element (8) may be powered and may communicate with a surface device (31) for the readout and recording of data. Such communication is usually set up over a cable (9), and the inductive element (8) may be powered by a variable voltage source via the cable (9). For certain aspects, the inductive element (8) may be used to align the wellbore completion string (5) within the wellbore. For example, as the wellbore completion string (5) is hung off by the tubing hanger (6) in the wellhead housing (1), the inductive element (8) may be aligned with components 1702 at the desired landing depth (dl).

Figure 18:
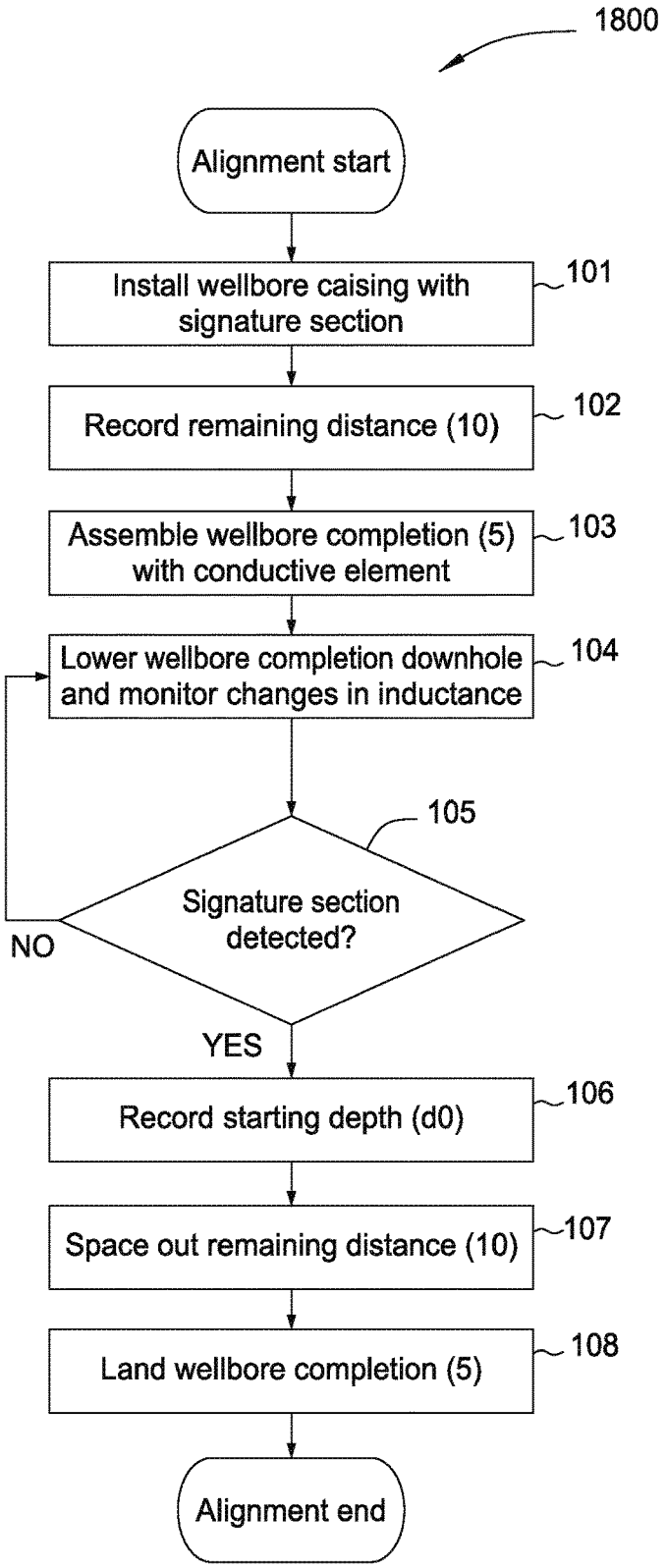
FIG. 18 illustrates example operations for aligning components in a well, according to an embodiment of the present invention.

FIG. 18 illustrates example operations 1800 for aligning components in a well, according to an embodiment of the present invention. At operation 101, a wellbore casing (2) is installed into the well. A second casing segment (2*b*), also named a signature segment, may be installed a distance called the remaining distance (10) from the desired landing depth (dl). As described above, compared to the first casing segment (2*a*), the second casing segment (2*b*) may have a difference in thickness, a difference in radii, or a difference in magnetic permeability. As another example, the first and second casing segments may have similar characteristics, but the second casing segment (2*b*) may include an inductive element or a permanent magnet.

At step 102, the remaining distance is recorded and will be used later in the process to align the wellbore completion string (5) with the wellbore casing (2). The wellbore casing (2) is terminated to the wellhead housing (1). The wellbore casing (2) projects through a wellbore and formation (13) and is typically cemented (12) along its outer surface up towards the wellhead housing (1).

At step 103, the wellbore completion string (5) is assembled. The phase of running the final tubing assembly into the well is often referred to as running the wellbore completion string. The wellbore completion string (5) is a tubing assembly that generally includes a bottom hole assembly (BHA) (11), such as a packer device. Above the BHA (11), an inductive element (8) is installed. In an embodiment, the inductive element (8) is attached to a downhole cable (9) that may be run and clamped along the wellbore completion string (5). The inductive element (8) is powered through the downhole cable (9).

At step 104, the wellbore completion string (5) with the inductive element (8) is lowered or run downhole the well. It is known that the flow of current through the inductive element (8) results in an induced magnetic. The interaction of the magnetic field with its local environment may result in a detectable change in the inductance of circuit containing the inductive element (8) (e.g., changes in the voltage or current as a function of time). Methods for detecting and measuring changes in the inductance of a circuit are well known in the art.

At step 105, the lowering of the wellbore completion string (5) will continue until the signature segment (the second casing segment) (2*b*) is detected. As the inductive element (8) comes into proximity with the second casing segment (2*b*), the surface device (31) may receive signals from the inductive element (8) that indicate changes in inductance. The changes in inductance may be monitored real-time in order to do final in-well run in. The changes in inductance are generally indicative of changes in the wellbore environment, such as the change in characteristics from the first casing segment (2*a*) to the second casing segment (2*b*) (e.g., a difference in thickness, a difference in radii, or a difference in magnetic permeability). Thus, using the inductive element (8) to monitor for changes in inductance as the wellbore completion string (5) is run downhole, the second casing segment (2*b*) may be detected as the inductive element (8) comes into proximity with the second casing segment (2*b*).

At step 106, when the second casing segment (2*b*) has been detected, the current depth, or a space-out starting depth (d0) of the wellbore completion string (5) is recorded. At step 107, since the remaining distance (10) between the second casing segment (2*b*) and the desired landing depth (dl) is known and recorded earlier (at step 102), the remaining distance can now be spaced out. This may include calculation of the number and lengths of casing segments (e.g., tubing and joints) necessary to add (or remove) up to the remaining distance (10) if jointed tubulars are used. The calculation should take into account that tubing may be available only in certain fixed lengths. For some embodiments, the length by which the string is to be adjusted may be compensated for conditions in the wellbore. For example, the known distance between the second casing segment (2*b*) and the desired landing depth (dl) may be adjusted for the differential in surface temperature (where the spacing between the second casing segment (2*b*) and the desired landing depth (dl) was initially measured) and the downhole temperature. The known length may also be corrected for the stress on the tubing (e.g., casing) due to tension (or compression).

The knowledge of the recorded remaining distance (10) and the detection of the signature joint or second casing segment (2*b*) can then be used to effectively and accurately space out the remaining distance (10) in order to align components whose relative position versus the second casing segment (2*b*) in the wellbore casing and relative position versus the inductive element (8) in the wellbore completion string are known. In other words, detection of the second casing segment (2*b*) may indicate a particular distance (e.g., desired landing depth (dl)) to a component that needs to be aligned with the wellbore completion string (5) (e.g., component 1702 with the inductive element (8)).

At step 108, the tubing hanger (6) is landed in the wellhead housing (1) when all the tubing required for space-out has been added to the wellbore completion string (5). The wellbore is now completed and the components in the well are aligned. For example, as the wellbore completion string (5) is hung off by the tubing hanger (6) in the wellhead housing (1), the inductive element (8) may be aligned with component 1702 at the desired landing depth (dl). As a result, the inductive element (8) generates a magnetic field that is inductively coupled to the component 1702 as the inductive element (8) aligns with the component 1702. In other words, the component 1702 may be powered by being inductively coupled to the inductive element (8). Certain applications require components, such as formation sensors, behind the casing in order to obtain measurements. Therefore, power and communications across the wellbore casing is made possible by the inductive coupling. However, the use of inductive elements in a coupler configuration requires particular closeness of the elements in the well to establish satisfactory transmission amplitude to meet the power and communication requirements. Thus, it is an object of the present invention is to navigate in the well so the two conductive elements are within proximity as the wellbore completion string is landed and hung off in the wellhead housing.

As with the inductive element (8), the component 1702 at the desired landing depth (dl) may be an inductive element that is axially wound over a section of a casing segment. When the component 1702 is exposed to a magnetic field from the inductive element (8), the component 1702 may convert the magnetic field into a voltage output. Thus, the component 1702 harvests energy from the magnetic field induced by inductive element (8) and converts it to electric energy to power the component 1702, or other apparatus connected to the component 1702.

For certain aspects, rather than lowering the wellbore completion string (5) until the second casing segment (2*b*) is detected, the wellbore completion string (5) may be lowered until a number a casing collars have been detected. In other words, the signature segment may include one or more casing collars. The variations in measured inductance as the inductive element (8) transitions across the casing collar may be used to indicate the inductive element (8) is adjacent to a collar. By counting the number of such occurrences and comparing the count to the casing tally, the position of the inductive element (8) in the wellbore may be determined relative to a particular casing joint.

In one embodiment, the signature segment generally includes a known unique spacing between two casing collars which is used to identify a specific location in the wellbore as the inductive element (8) is run into the well. In this case, the change in inductance due to the presence of the uniquely spaced casing collars may be detected when the completion is lowered by an amount roughly equivalent to the unique spacing between the two casing collars. The signature segment described above may be positioned a known distance above the desired landing depth, allowing calculation and installation of the amount of tubing to reach the landing depth coincident with the top of the tubing landing at the tubing hanger.

In one embodiment, the signature segment generally includes a casing collar of a known unique length which may be used to identify a particular location in the wellbore as the inductive element (8) is run into the well. In this case, the change in inductance due to the presence of the unique casing collar will be detected when the wellbore completion string (5) is lowered adjacent to the unique casing collar. The inductance measurement indicative of the presence of the collar will persist as the inductive element (8) is lowered by an amount roughly equivalent to the known unique length of this casing collar. The signature segment described above may be positioned a known distance above the desired landing depth, allowing calculation and installation of the amount of tubing to reach the landing depth coincident with the top of the tubing landing at the tubing hanger. Other inductance influencing elements (e.g. materials of differing permeability, thickness, or radii) of unique and known lengths may be used in place of the casing collar.

For some embodiments, the material from which one or more casing collars are constructed may be chosen to have a magnetic permeability different from that of the other casing collars. In this embodiment, the change in inductance due to the presence of the permeability contrast between collars will be detected when the wellbore completion string (5) is lowered adjacent to the unique casing collar. The inductance measurement indicative of the presence of the collar will persist as the inductive element (8) is lowered by an amount roughly equivalent to the length of this casing collar.

Figure 19:
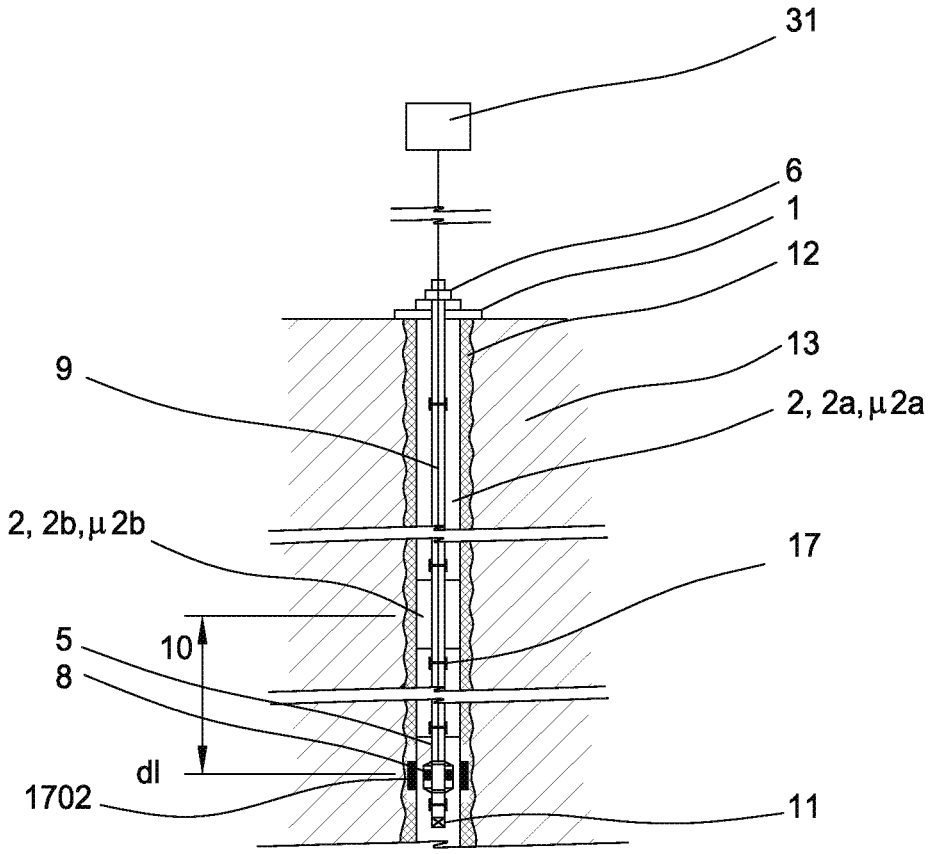
FIG. 19 illustrates an aligned wellbore completion string in a wellbore, according to an embodiment of the present invention.

FIG. 19 illustrates an aligned wellbore completion string in a wellbore, according to an embodiment of the present invention. The inductive element (8) has now been lowered down to the landing depth (dl), and would therefore be aligned with a component 1702, such as a sensor with an inductive element. It should be noted that components or apparatuses arranged at a known distance from the inductive element (8) may be aligned with components or apparatuses arranged at a known distance from the second casing segment (2*b*) of the wellbore casing (2), since these distances will only be relative to the known locations when the second casing segment (2*b*) has been detected.

According to an embodiment, the accurate landing depth (dl) is known when the second casing segment (2*b*) has been detected by the inductive element (8) of the wellbore completion string (5), and the necessary remaining space out can be calculated based on the remaining distance (10) and the current height of the wellbore completion string above the wellhead housing (1). Necessary additional lengths of tubing can then be calculated for the space out and termination in the tubing hanger (6).

According to an embodiment, the operation of spacing-out the remaining distance (10) comprises mounting additional tubing segments with a total length (tl) equal to the remaining distance (10) minus the distance from the top of the current tubing string to the tubing hanger, and lowering the wellbore completion string (5) a distance equal to the remaining distance (10).

Figure 20:
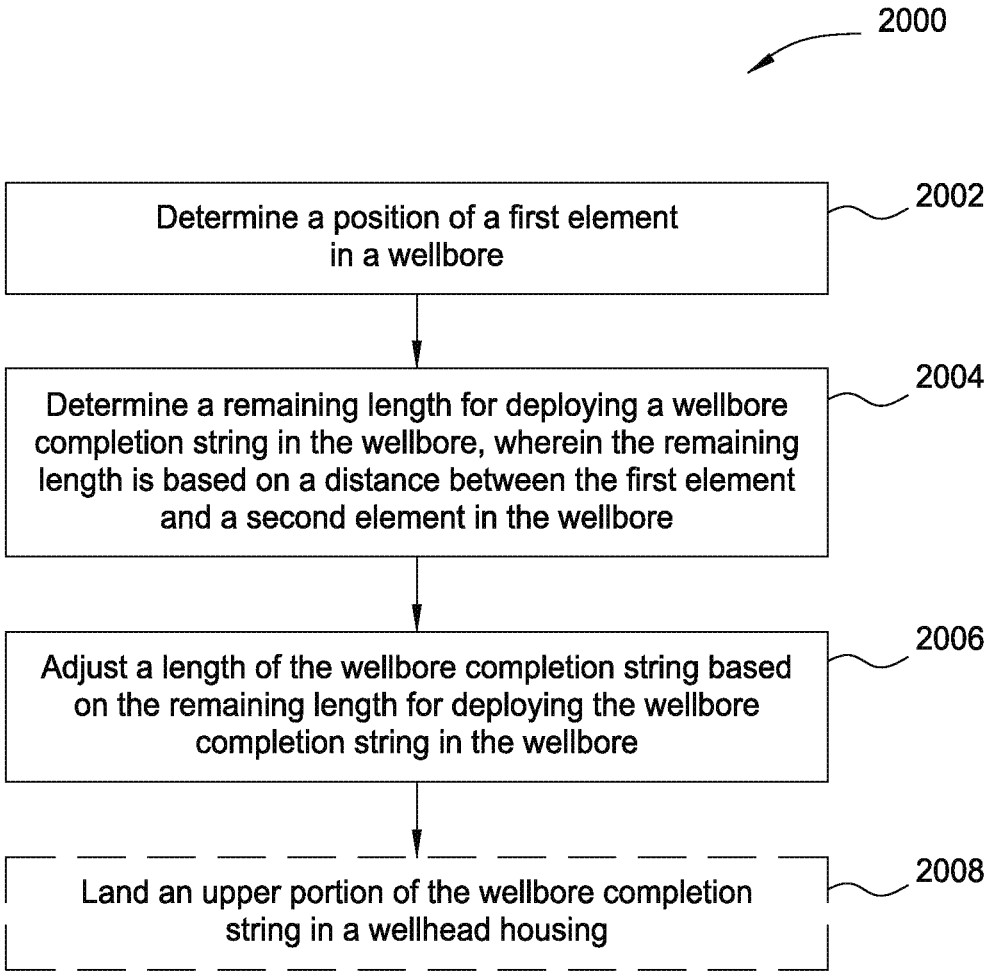
FIG. 20 illustrates example operations for deploying a wellbore completion string in a wellbore, according to an embodiment of the present invention.

FIG. 20 illustrates example operations 2000 for deploying a wellbore completion string in a wellbore, according to an embodiment of the present invention. At 2002, a position of a first element in the wellbore is determined. For certain aspects, determining the position of the first element in the wellbore generally includes detecting a change in inductance of a third element located on the wellbore completion string as the third element comes into proximity with the first element, and determining a position at which the third element detects the change in inductance to be the position of the first element. The third element on the wellbore completion string is an inductive element that is coaxially positioned on an outside surface of the wellbore completion string. The first element in the wellbore generally includes a difference in thickness between two casing segments disposed in the wellbore, a difference in radii between the two casing segments, a difference in magnetic permeability between the two casing segments, an inductive element, or a permanent magnet.

At 2004, a remaining length for deploying the wellbore completion string in the wellbore is determined, wherein the remaining length is based on a distance between the first element and a second element in the wellbore. For certain aspects, a position of the second element in the wellbore is known relative to the determined position of the first element in the wellbore.

At 2006, a length of the wellbore completion string is adjusted, wherein the adjustment is based on the remaining length for deploying the wellbore completion string in the wellbore. Upon adjusting the length of the wellbore completion string, the third element may be aligned with the second element in the wellbore. The third element generates a magnetic field that is inductively coupled to the second element in the wellbore as the third element aligns with the second element. At 2008, landing an upper portion of the wellbore completion string in a liner hanger is coincident with the alignment of the third element with the second element. For certain aspects, adjusting the length of the wellbore completion string generally include increasing the length of the wellbore completion string in order to align the third element and land the upper portion of the wellbore completion string. For certain aspects, adjusting the length of the wellbore completion string generally include increasing the length of the wellbore completion string by an amount equal to the distance between the first and second elements in the wellbore.

Embodiments of the present invention disclose methods and apparatus that will assist operation to accurately establish the correct space out of a well completion string being run downhole in order to align and enable wireless communication between an inductive element attached to the completion string and an inductive element fixed to the casing. It will also be understood by those skilled in the art that the method, apparatus and practice here disclosed will reduce operational time and risk of running a completion into a well. In one embodiment, the invention provides in-well proximity indications which depict the distance to the inductive element fixed to the casing, thereby allowing the landing of the tubing at the tubing hanger to coincide with the alignment of the inductive elements on the casing and completion string. Thus, space-out of a wellbore completion string may be performed by inward movement of the well completion string without requiring the string to be moved in and out to establish required proximity of the inductive elements.

An advantage of the present invention is that same system components and infrastructure (e.g., communication networks) can be used both for the initial alignment and for the later monitoring of the formation parameters. The invention will ease the installation of components in wells operated from a floating rig or vessel as well as those deep into the earth that need to be aligned between the wellbore completion and the wellbore casing, such as inductive couplers.

In one or more exemplary embodiments, the functions described may be implemented in hardware, software, firmware, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

While the foregoing is directed to embodiments of the present invention, other and further embodiments of the invention may be devised without departing from the basic scope thereof, and the scope thereof is determined by the claims that follow.

The invention claimed is:

1. A method for deploying a wellbore completion string in a wellbore, the method comprising:

positioning the wellbore completion string in the wellbore, wherein the wellbore completion string has a length and comprises an inductive element coaxially that is positioned on an outside surface of the wellbore completion string and that is in communication with a surface device;

detecting a change in inductance of the inductive element as the inductive element comes into proximity with a first element;

determining a position of the first element in the wellbore;

calculating a remaining length for deploying the wellbore completion string in the wellbore to a second element, wherein the remaining length is based on a distance between the first element and the second element in the wellbore;

adjusting the length of the wellbore completion string based on the remaining length for deploying the wellbore completion string in the wellbore to the second element; and landing, relative to the wellbore, the wellbore completion string while the wellbore completion string is at the adjusted length;

wherein landing the wellbore completion string comprises landing an upper portion of the wellbore completion string in a wellhead housing, wherein adjusting the length of the wellbore completion string comprises adding a plurality of tubular segments to the upper portion of the wellbore completion string; and wherein detecting the change in inductance, determining the position of the first element in the wellbore, calculating the remaining length, adjusting the length of the wellbore completion string based on the remaining length, and landing the completion string occurs during a one-way continuous movement without any reversing action of the wellbore completion string.

2. The method of claim 1, wherein determining the position of the first element in the wellbore comprises:

determining a position at which the inductive element detects the change in inductance to be the position of the first element.

3. The method of claim 2, further comprising:

aligning the inductive element located on the wellbore completion string with the second element in the wellbore.

4. The method of claim 3, wherein the inductive element located on the wellbore completion string generates a magnetic field that is inductively coupled to the second element in the wellbore as the inductive element aligns with the second element.

5. The method of claim 1, wherein aligning the inductive element located on the wellbore completion string and landing the upper portion of the wellbore completion string is based on the adjusted length of the wellbore completion string.

6. The method of claim 5, wherein adjusting the length of the wellbore completion string comprises increasing the length of the wellbore completion string in order to align the inductive element located on the wellbore completion string and land the upper portion of the wellbore completion string.

7. The method of claim 1, wherein adjusting the length of the wellbore completion string comprises increasing the length of the wellbore completion string by an amount equal to the distance between the first and second elements in the wellbore.

8. The method of claim 1, wherein the first element in the wellbore comprises a difference in thickness between two casing segments disposed in the wellbore, a difference in radii between the two casing segments, a difference in magnetic permeability between the two casing segments, an inductive element, or a permanent magnet.

9. The method of claim 1, wherein a position of the second element in the wellbore is known relative to the determined position of the first element in the wellbore.

10. The method of claim 1, wherein the detecting of the first element in the wellbore further comprises detecting a change in magnetic permeability.

11. A method for deploying a wellbore completion string in a wellbore, the method comprising:

detecting a change in inductance of a magnetic dipole as the magnetic dipole comes into proximity with a first element, the magnetic dipole being an inductive coil axially wound over a section of the wellbore completion;

determining a position of the first element in the wellbore;

calculating a remaining length for deploying the wellbore completion string in the wellbore to a second element including an external magnetic dipole, wherein the remaining length is based on a distance between the first element and the second element in the wellbore;

adjusting a length of the wellbore completion string based on the remaining length for deploying the wellbore completion string in the wellbore to the second element; and landing, relative to the wellbore, the wellbore completion string thereby aligning the magnetic dipole with the external magnetic dipole;

wherein landing the wellbore completion string comprises landing an upper portion of the wellbore completion string in a wellhead housing, wherein adjusting the length of the wellbore completion string comprises adding a plurality of tubular segments to the upper portion of the wellbore completion string; and wherein detecting the change in inductance, determining the position of the first element in the wellbore calculating the remaining length, adjusting the length of the wellbore completion string based on the remaining length, and landing the completion string occurs during a one-way continuous movement without any reversing action of the wellbore completion string.

12. The method of claim 11, wherein determining the position of the first element in the wellbore comprises:

determining a position at which the magnetic dipole detects the change in inductance to be the position of the first element.

13. The method of claim 12, further comprising:

aligning the magnetic dipole located on the wellbore completion string with the second element in the wellbore.

14. The method of claim 13, wherein the magnetic dipole located on the wellbore completion string generates a magnetic field that is inductively coupled to the second element in the wellbore as the magnetic dipole aligns with the second element.

15. A method for deploying a wellbore completion string in a wellbore, the method comprising:

detecting a change in inductance of a magnetic dipole as the magnetic dipole comes into proximity with a first element, the magnetic dipole coaxially positioned on an outside surface of the wellbore completion string and in communication with a surface device via a cable providing electric power from the surface device to the magnetic dipole:

determining a position of the first element in the wellbore:

calculating a remaining length for deploying the wellbore completion string in the wellbore to a second element, wherein the remaining length is based on a distance between the first element and the second element in the wellbore;

adjusting a length of the wellbore completion string based on the remaining length for deploying the wellbore completion string in the wellbore to the second element; and landing, relative to the wellbore, the wellbore completion string;

wherein landing the wellbore completion string comprises landing an upper portion of the wellbore completion string in a wellhead housing, wherein adjusting the length of the wellbore completion string comprises adding a plurality of tubular segments to the upper portion of the wellbore completion string; and wherein detecting the change in inductance, determining the position of the first element in the wellbore, calculating the remaining length, adjusting the length of the wellbore completion string based on the remaining length, and landing, the completion string occurs during a one-way continuous movement without any reversing action of the wellbore completion string.

16. The method of claim 15, wherein determining the position of the first element in the wellbore comprises:

determining a position at which the magnetic dipole detects the change in inductance to be the position of the first element.

17. The method of claim 16, wherein landing, the wellbore completion string aligns the magnetic dipole located on the wellbore completion string with the second element in the wellbore.

18. The method of claim 17, wherein the magnetic dipole located on the wellbore completion string generates a magnetic field that is inductively coupled to the second element in the wellbore as the magnetic dipole aligns with the second element.

* * * * *